US010945900B1

(12) United States Patent
Ousborne et al.

(10) Patent No.: US 10,945,900 B1
(45) Date of Patent: Mar. 16, 2021

(54) POWERED WHEELCHAIR FOR BEACH TERRAIN

(71) Applicants: Jeffrey J. Ousborne, Clarksville, MD (US); Nicholas J. Ousborne, Ocean City, MD (US)

(72) Inventors: Jeffrey J. Ousborne, Clarksville, MD (US); Nicholas J. Ousborne, Ocean City, MD (US)

( * ) Notice: Subject to any disclaimer, the term of this patent is extended or adjusted under 35 U.S.C. 154(b) by 276 days.

(21) Appl. No.: 16/020,513

(22) Filed: Jun. 27, 2018

Related U.S. Application Data

(60) Provisional application No. 62/583,193, filed on Nov. 8, 2017.

(51) Int. Cl.
*A61G 5/06* (2006.01)
*A61G 5/04* (2013.01)
*A61G 5/10* (2006.01)

(52) U.S. Cl.
CPC ..... *A61G 5/06* (2013.01); *A61G 5/04* (2013.01); *A61G 5/1005* (2013.01); *A61G 5/1051* (2016.11)

(58) Field of Classification Search
CPC . A61G 5/06; A61G 5/04; A61G 5/045; A61G 5/1005; A61G 5/1032
See application file for complete search history.

(56) References Cited

U.S. PATENT DOCUMENTS 4,666,170 A 5/1987 Vasa
4,805,712 A * 2/1989 Singleton ..... A61G 5/1051 180/65.1
4,926,952 A * 5/1990 Farnam ..... A61G 5/046 180/251
4,953,645 A 9/1990 Korber et al.
5,482,125 A * 1/1996 Pagett ..... A61G 5/042 180/6.32
5,518,081 A 5/1996 Thibodeau
5,778,996 A 7/1998 Prior et al.
6,443,251 B1 9/2002 Morrell et al.
6,443,252 B1 9/2002 Andes
6,631,774 B2 * 10/2003 Hayashi ..... B62K 5/007 180/65.1
6,857,490 B2 2/2005 Quigg
7,360,792 B2 * 4/2008 Turturiello ..... A61G 5/042 280/755

(Continued)

*Primary Examiner* — Tony H Winner
*Assistant Examiner* — Michael R Stabley
(74) *Attorney, Agent, or Firm* — Rosenberg, Klein & Lee

(57) ABSTRACT

A powered wheelchair for beach terrain is provided that includes a an occupant seat assembly mounted to a frame that has an electric drive system with a pair of electric motors mounted thereto. A hand grip support frame is coupled to a rear end of the frame. The electric drive system is drivingly coupled to at least two of a plurality of wheels rotatably mounted to the frame. The powered wheelchair includes a portable power source and a control system mounted to the main frame. The control system is electrically coupled to the portable power source and the electric drive system. The control system has a first set of operating controls disposed in proximity to the occupant seat assembly and a second set of operating controls disposed in proximity the hand grip support frame for switch selective operative control of the powered wheelchair.

26 Claims, 13 Drawing Sheets

(56) References Cited

U.S. PATENT DOCUMENTS

| | | | | |
|---|---|---|---|---|
| 7,398,842 | B2 * | 7/2008 | Fontecchio | B62D 11/003 180/6.5 |
| 7,481,445 | B1 * | 1/2009 | Danziger | A61G 5/08 280/250.1 |
| 7,971,893 | B1 * | 7/2011 | Dunn | A61G 5/045 180/19.1 |
| 8,104,554 | B2 | 1/2012 | Graham | |
| 8,127,875 | B2 | 3/2012 | Mattes et al. | |
| 8,678,402 | B2 | 3/2014 | Helterbrand | |
| 8,789,328 | B2 | 7/2014 | Swenson | |
| 9,456,942 | B2 | 10/2016 | Peters et al. | |
| 9,662,251 | B2 | 5/2017 | Fertig et al. | |
| 10,052,247 | B2 * | 8/2018 | Vereen, III | A61G 5/107 |
| 2009/0095547 | A1 * | 4/2009 | Swett | B60K 1/00 180/65.1 |
| 2010/0096194 | A1 * | 4/2010 | Starcevic | A61G 5/061 180/8.2 |
| 2017/0151111 | A1 | 6/2017 | Peek | |

* cited by examiner

POWERED WHEELCHAIR FOR BEACH TERRAIN

BACKGROUND OF THE INVENTION

1. Field of the Invention

This disclosure directs itself to a powered wheelchair for beach terrain that permits speed and direction control to be selectively enabled for either the occupant of the wheelchair or an assistant who walks behind the wheelchair, while an emergency stop function is available for use by both the occupant and the assistant at any time. More in particular, the disclosure is directed to a powered wheelchair having wide and large diameter tires of which, at least two are respectively drivingly coupled to a pair of electric motors. Still further, the disclosure is directed to a powered wheelchair wherein the handles of the wheelchair at the rear end thereof are oriented vertically and with operating controls for use by an assistant being single axis controls in close proximity to the handles so that the assistant is able to maintain a grasp of the handles while simultaneously operating the controls. Further, the disclosure is directed to a powered wheelchair having four wheels with wide and large diameter tires respectively drivingly coupled to a pair of gear speed reduced electric motors and corresponding chain and sprocket power transmissions. Further still, the disclosure is directed to a powered wheelchair having a pair of batteries interchangeably mounted on the powered wheelchair with only one battery being operatively coupled to the drive system of the wheelchair and the other battery being carried as a spare to alternately be connected to the drive system when needed.

2. Prior Art

Traditional push and powered wheelchairs are very difficult to maneuver on soft sand. Unpowered wheelchairs can require 2 or 3 people to move through soft sand. Traditional powered wheelchairs get stuck when the narrow and small wheels sink into soft sand. Traditional powered wheelchairs are designed to be controlled by the occupant and lack the ability for an attendant or assistant to control the speed and direction of the powered wheelchair. More recently, powered wheelchairs have been marketed that are capable of traversing various terrains, such as sand and snow. However, these systems utilize complex drive systems and lack the ability for an assistant to control the speed and direction of the powered wheelchair.

One prior art device defined in U.S. Pat. No. 6,443,251 is directed to a powered wheelchair capable of carrying an assistant as a second rider and provides the assistant with a second set of operating controls. However, the casters utilized for a platform that carries the second rider and wheels of an anti-tipping structure make the wheelchair unsuitable for use in soft terrain such on a sandy beach To overcome the deficiencies in prior art wheelchairs ability to traverse beach terrain, the powered wheelchair disclosed herein is designed to easily travel over soft sand using wide and large diameter tires and high torque gear reduced motors and speed reducing power transmission system. The disclosed powered wheelchair is controlled by either the occupant of the wheelchair or an assistant, but not both. Yet, for safety, regardless of for whom the control of speed and direction of the wheelchair has been selected, both the occupant and the assistant are able initiate an emergency stop function of the wheelchair at any time. These and other advantages and novel features will become apparent from the disclosure herein.

SUMMARY OF THE INVENTION

A powered wheelchair for beach terrain is provided that includes a frame assembly. The frame assembly includes a longitudinally extended main frame and a hand grip support frame extending from an end of said main frame in a direction transverse with respect to the longitudinal direction of said main frame. The powered wheelchair further includes an occupant seat assembly mounted to the main frame and an electric drive system mounted to the main frame. Further, the powered wheelchair includes a plurality of wheels rotatably coupled to the main frame. At least two of the plurality of wheels on opposing sides of the main frame are drivingly coupled to the electric drive system. Still further, the powered wheelchair includes a portable power source mounted to the main frame and a control system mounted to the main frame and electrically coupled to the portable power source and the electric drive system. The control system has a first set of operating controls disposed in proximity to the occupant seat assembly for use by an occupant thereof and a second set of operating controls disposed in proximity to the hand grip support frame for use by an assistant operator.

From another aspect, a powered wheelchair for beach terrain is provided that includes a frame assembly including a main frame and a hand grip support frame extending substantially vertically upward from a rear end of the main frame. The hand grip support frame has a horizontal frame member. Further, the powered wheelchair includes an occupant seat assembly mounted to the main frame adjacent a front end thereof, and a plurality of wheels rotatably coupled to the main frame on two opposing sides thereof. The powered wheelchair further includes a pair of electric motors mounted to the main frame, and a portable power source mounted to the main frame. Each of the pair of electric motors is drivingly coupled to at least one of the plurality of wheels on one respective side of the main frame. Still further, the powered wheelchair includes a control system mounted to the main frame and electrically coupled to the portable power source and the pair of electric motors. The control system includes a first set of operating controls disposed in proximity to the occupant seat assembly for use by an occupant thereof and a second set of operating controls disposed in proximity to the hand grip support frame for use by an assistant operator. The control system further includes a motor drive circuit for each of the pair of electric motors and an emergency stop circuit. The emergency stop circuit electrically disconnects the portable power source from the motor drive circuits responsive to detection of either of a manual operation of at least one emergency stop switch or detection of a failure of either of the motor drive circuits. The initiation of the emergency stop circuit activates dynamic braking of the pair of electric motors.

DETAILED DESCRIPTION OF THE PREFERRED EMBODIMENTS

Referring to FIGS. 1-9, there is shown powered wheelchair 100, 200 for traversing terrain where the surface is not hard and smooth. It should be understood that the illustrations shown in FIGS. 1-9 of powered wheelchair 100, 200 are being presented without decorative and/or protective covers in place, and in some drawings certain component are omitted, to enable the major mechanical components of powered wheelchair 100, 200 to be unobstructed thereby.

Figure 5:
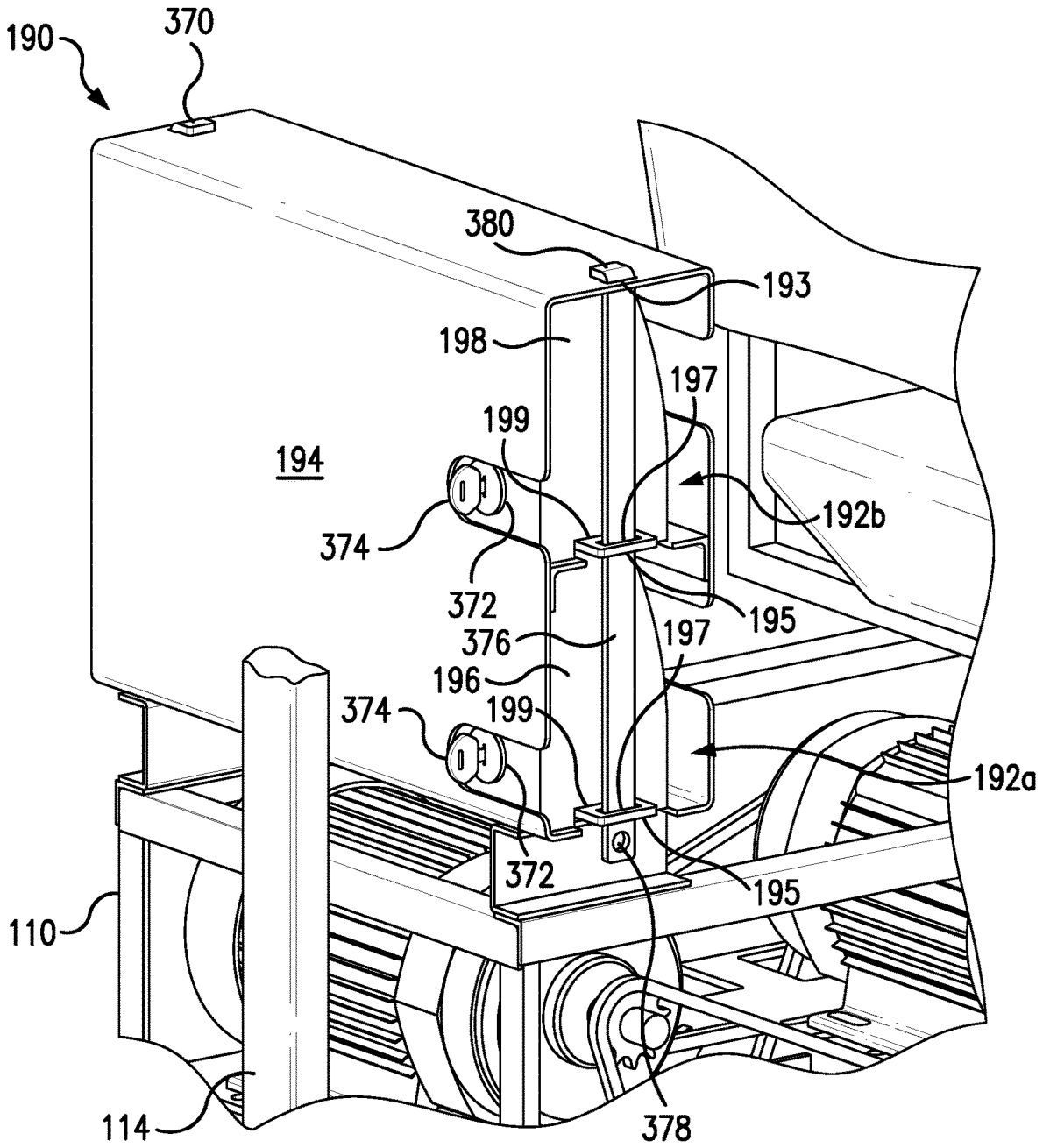
FIG. 5 is a cutaway view of the powered wheelchair showing the power system.

In general, powered wheelchair 100, 200 is designed for operation on beach terrain where soft loosely packed sand has heretofore made use of a wheelchair, powered or not, a daunting endeavor. Powered wheelchair 100, 200 includes a frame assembly 105 that includes a main frame 110 to which an occupant seat assembly 120 is secured and to which an electric drive system 150, 210 is mounted. The electric drive system 150, 210 is powered by a power system 190 through a control system 180. With particular reference to FIG. 5, power system 190 defines the power source for powered wheelchair 100, 200 and includes a battery case 194 and a pair of batteries 196 and 198 removably installed, without the need for tools, in the battery case 194. The two batteries 196, 198 are each high capacity portable batteries, such as the MENG 48V 20 AH lithium battery pack, and have a carrying handle incorporated therewith. Each of these high capacity batteries 196, 198 provides adequate range and duration to the powered wheelchair 100, 200. One battery 196 is electrically connected, by a connector that engages a mating connector in the battery case 194, to connect to the control system 180 to power the electric drive system 150, 210. While the second battery 198 is provided as a backup battery that can be interchanged with the first battery 196 to maintain continuous operation of powered wheelchair 100 in the event battery 196 becomes depleted, or to otherwise enable the battery 196 to be removed and remotely charged without impairing availability of powered wheelchair 100, 200 for use.

The battery case 194 includes two battery receiving bays 192*a* and 192*b*, each with a battery guide rail 195. The rear end of battery case 194 has a rear member 370 affixed thereto that blocks the rear opening of the two battery receiving bays 192*a* and 192*b*. The battery bay 192*a* contains the wheelchair's power connector (not shown) for connection to the mating connector of battery 196. Each of the batteries 196 and 195 has a longitudinal recess 199 formed therein in which the corresponding battery guide rail 195 is received. Each of the batteries 196 and 195 is secured in place by a key operated securement lock 372. The securement lock 372 of each battery 196, 198 is operated by a removably insertable key 374 that rotated the lock barrel thereof to reversibly extend a lock bolt (not shown) from a bottom of the battery that is received within a through opening formed in the battery guide rail 195 (not shown). To further prevent unauthorized access to the batteries 196 and 198, a battery case securement member 376 is releasably coupled to the battery case 194. Battery case securement member 376 is slidably received through slotted opening 193 in the top of battery case 194 and the slotted opening 197 formed in each of the battery guide rails 195. The battery case securement member 376 has and end portion 380 bent to form a stop to limit the passage of the member 376 through the slotted opening 193. The opposing end portion of the battery case securement member 376 is provide with a through opening 378 for receiving the hasp of a padlock therethrough to lock the battery case securement member 376 in place. Thus, it can be seen that the battery 196 can be easily interchanged with the battery 198 without the use of tools, by slidingly removing the battery case securement member 376, releasing the securement lock 372 of the batteries 196 and 198 using the corresponding key therefor, thereby freeing the batteries for interchange.

For control of powered wheelchair 100, 200 by an assistant, the frame assembly 105 includes a hand grip support frame 114 that extends transversely from the rear end of the main frame 110, extending substantially vertically upward. The hand grip support frame 114 has a horizontal frame member 116 connected at an upper end thereof. The horizontal frame member 116 has a substantially U-shape with a respective one of a pair of hand grips 118 extending from each of opposing end portions of horizontal frame member 116. Each of the pair of hand grips 118 extends in a substantially vertically downward direction to provide an ergonomic improvement for handling the wheelchair by the assistant. Extending hand grips 118 in a substantially vertically downward direction is beneficial for exerting force in a straight line and in the same direction as the assistant's straightened forearm and wrist, particularly when the force must be applied horizontally, in circumstances that require wheelchair 100, 200 to be pushed or pulled. This arrangement of hand grips 118 allows the assistant to have a more secure hold on to wheelchair 100, 200 and maintain that hold while operating the assistant controls 144. Hand grips 118 have an outer surface designed to ensure a good grip thereon, providing added friction between the assistant's hand and the hand grips 118. This is particularly important where force must be applied with a sweaty, wet or sandy hand. The outer surface material is a non-slip and compressible materials that absorbs shock and vibration, such as textured or foamed rubber compounds and thermoplastic elastomers.

Figure 1:
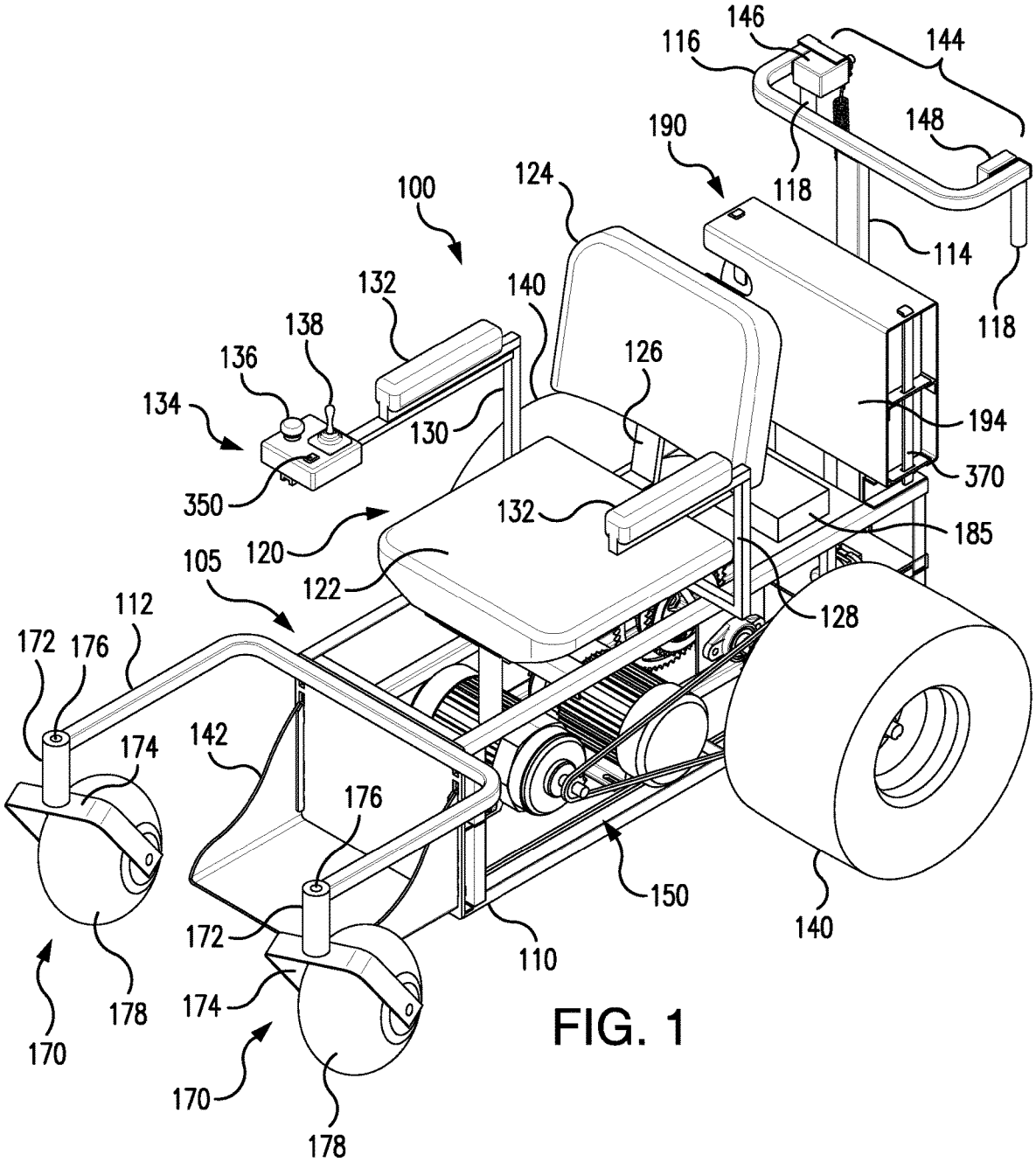
FIG. 1 is a perspective view of the powered wheelchair of the present invention.
Figure 2:
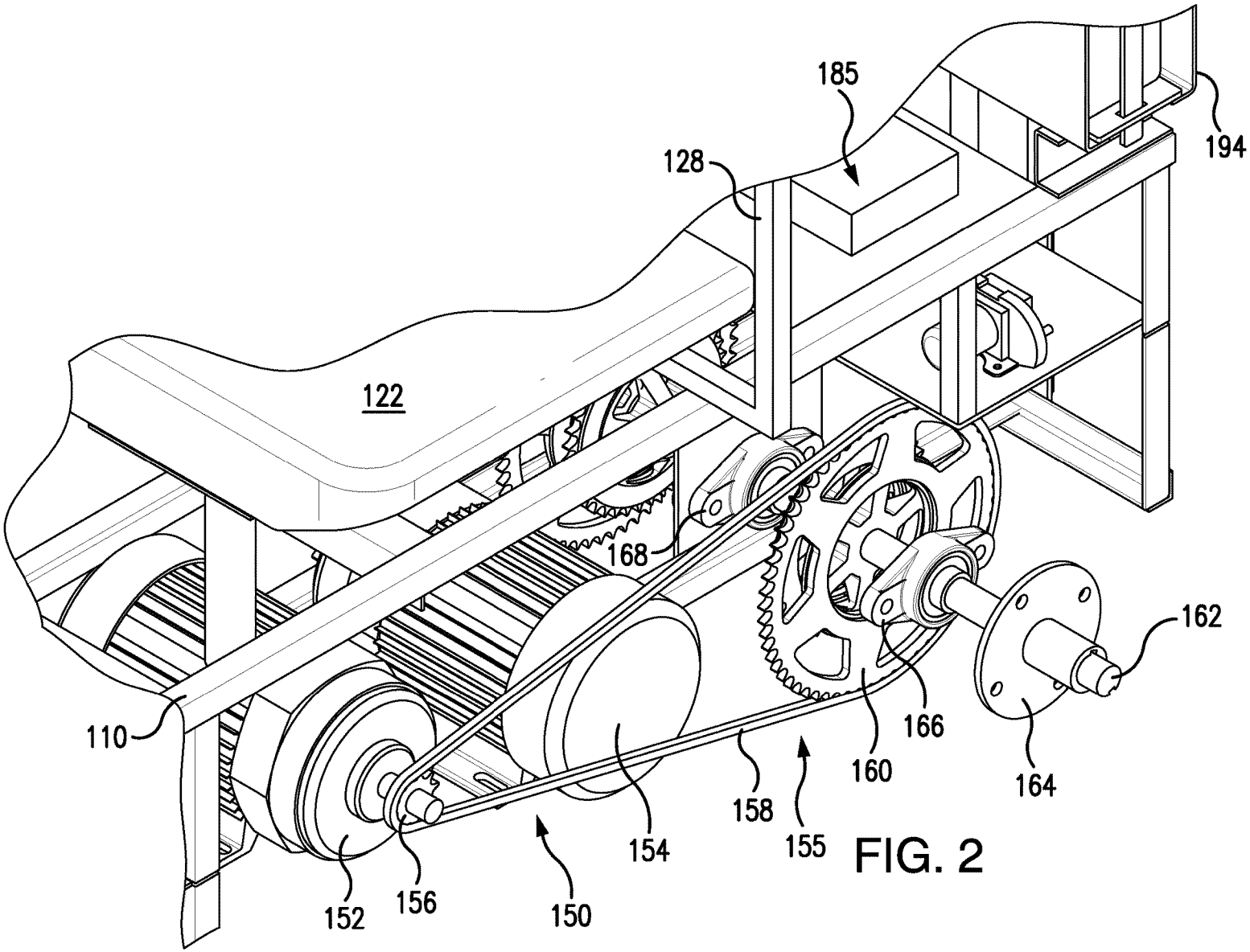
FIG. 2 is a cutaway view of the powered wheelchair showing the electric drive system.

Turning specifically to FIGS. 1 and 2, there is shown powered wheelchair 100 that employs two powered wheels 140 and two caster wheel assemblies 170. Powered wheelchair 100 has a frame assembly 105 that includes a main frame 110, a front wheel frame 112 coupled at a front longitudinal end of the main frame 110 and a hand grip support frame 114 that is coupled on an opposing longitudinal end of main frame 110. The front wheel frame 112 is a substantially U-shaped member to which each of a pair of pivot sockets 172 are respectively coupled to opposing ends of the front wheel frame 112, for pivotal coupling of the pair of caster wheel assemblies 170 thereto. Each of the pair of caster wheel assemblies 170 includes a substantially U-shaped wheel frame 174 to which a wheel 178 is rotatably coupled, which wheel is both wider and of greater diameter than that of conventional wheelchair caster wheels. Each wheel frame 174 has a centrally located pivot axle 176 extending therefrom and pivotally coupled to a respective one of the pivot sockets 172. The powered wheelchair 100 has an occupant seat assembly 120 mounted to an upper side of the main frame 110 adjacent the front end thereof. A foot support 142 is provided adjacent the front end of the main frame 110 for use by the occupant seated in the occupant seat assembly 120.

The occupant seat assembly 120 includes a seat bottom 122 supported on the main frame 110 and a seat back 124 positioned with respect to the seat bottom 122 by a seat back support member 126. Seat assembly 120 further includes a first arm rest support member 128 positioned on one side of the seat bottom 122 and a second arm rest support member 130 on the opposing side of the seat bottom 122. A pair of padded arm rests 132 are respectively mounted to the first and second arm rest support members 128 and 130. In addition to a padded arm rest 132 being mounted to the second arm rest support member 130, a first set of operating controls 134 is also mounted to second arm rest support member 130 in proximity to the corresponding arm rest 132, at a position where the occupant's hand will be located to enable the occupant to control the wheelchair 100. The first set of operating controls 134 includes an emergency stop switch 136 and may include a control select switch 350 and a two axis joystick 138. The provision of a joystick for use by the wheelchair occupant is optional, and if not provided, then the control select switch 350 would likewise not be included. Control select switch 350 is depicted as rocker type switch, but may be any type of two position switch. For example, control select switch 350 may be a key operated switch to limit the ability to select between occupant control of wheelchair 100 and assistant control to an authorized person, a person who would have possession of the key for switch 350. Switch 350 may also be located elsewhere on wheelchair 100, as well, such as adjacent to the controller 185. The occupant's emergency stop switch 136 may be a commercially sold APEM A02-E01P emergency stop switch available from ERMEC SL of Barcelona, Spain. This switch is normally closed and when depressed, opens the switch contacts to initiate the emergency stop condition.

The two axis joystick 138 is located on the second arm rest support member 130 adjacent to the padded arm rest 132 to provide wheelchair speed and direction control by the wheelchair occupant, if an assistant is not required. A commercially sold APEM HF27R111 joystick available from ERMEC SL of Barcelona, Spain may be used as the occupant joystick 138. This joystick incorporates important safety features. First, each of the two axes has a spring return to their center position. The center position corresponds to a stopped wheel command and no turn commands, so the wheelchair is stopped if the joystick is released. For each axis, the output range is 1V to 4V with the 5V DC supply from power supply 188. If the sensors for either axis are disconnected, shorted to ground, or shorted to the +5V supply, these errors can be detected since they are outside the valid signal range of 1V. to 4V. Lastly, each axis of the joystick has redundant dual position sensors, each with its own output. One of the outputs has an output voltage range that is opposite, with respect to the other sensor output. Thus, the output of one sensor of the joystick, when displaced from end-to-end of one axis, produces an output that ramps up from 1 V. to 4 V. While at the same time, the output of the other sensor for that axis produces an output that ramps down from 4 V. to 1V. If the joystick axes have a sensor failure that results in a valid, but incorrect, voltage on the output of one sensor, the error can be detected by subtracting the center position voltage (2.5 V.) from both sensor outputs and summing the two resulting values. The sum of those values would be zero if the sensors are operating properly, and since it is unlikely that a sensor error would still produce the expected zero result, the control system 180 is able to detect the error.

The electric drive system 150 is drivingly coupled to the pair drive wheels 140, 140, each drive wheel 140 being disposed on opposing sides of main frame 110. Each drive wheel 140 has a wide and large diameter tire, such as a NANCO N800 (12" wide, 21" diameter) tire, to provide a large surface contact area that minimizes sinking into soft sand. The large diameter of the tires of drive wheels 140 and caster wheels 178 also allows for greater ground clearance enabling the vehicle to roll over ruts and holes typically found in soft sand beaches. Propelling a wheelchair through soft sand requires significantly more power and torque than propelling a wheelchair on hard surfaces and the large diameter of the wheels have the disadvantage of reducing the effective force of the motors. Therefore, significant torque is required to propel the wheelchair.

Figure 6:
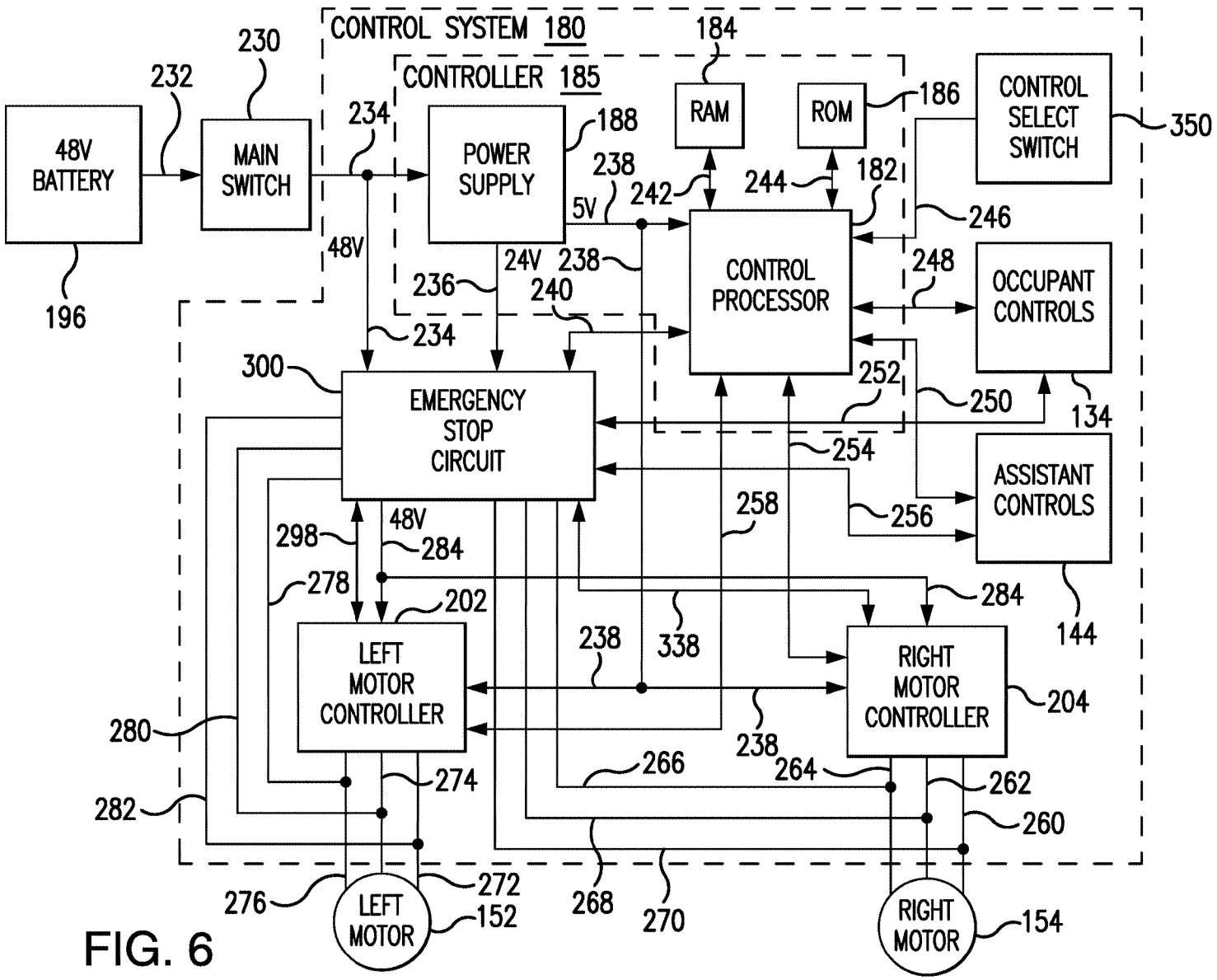
FIG. 6 is an electrical block diagram of the control system of the powered wheelchair.

To provide the necessary torque, electric drive system 150 includes two high power brushless motors 152 and 154, such as the Unite BM1418ZXF750 W 48V 750 W motors, with a torque of 15 N-m. The motors 152 and 154 include a 6:1 internal gear reduction that provides a maximum rotational speed of 467 rpm and are powered by the battery 196 of power system 190 through a respective motor controller 202, 204 of control system 180, as indicated in FIG. 6. Each of the electric motors 152 and 154 is coupled to a respective one of the drive wheels 140 by a chain and sprocket transmission 155. Each of the chain and sprocket transmissions 155 provides additional torque and corresponding wheel speed reduction using an 11 tooth motor sprocket 156 and a 60 tooth axle sprocket 160 drivingly coupled by a drive chain 158. Each chain and sprocket transmission 155 provides a speed reduction from the corresponding electric motor 152, 154 maximum rotational speed of 467 rpm to an 86 rpm maximum rotational speed of the axle 162, to which the axle sprocket 160 is coupled, and the wheel 140 therewith by its securement to the corresponding wheel mounting plate 164 that is affixed to the respective axle 162. The axles 162 on the two sides of the main frame 110 that rotate the wheels are rotatably driven independently of one another so that the attached wheels can be rotated at different speeds to affect a turning maneuver. The two axles 162 on opposing sides of main frame 110 are respectively rotatably supported by a pair of bearings 166 and 168. The bearings 166 and 168 are affixed to main frame 110 (not shown with respect to bearing 166 in order to clearly show other components of electric drive system 150). The aforesaid speed reduction results in a maximum speed of 5.4 mph, which maximum speed can be further limited by the controller 185 of control system 180. The limiting of the wheelchair speed is important when an assistant is controlling the powered wheelchair 100, as the assistant operates the assistant operating controls 144 while walking behind the powered wheelchair 100.

Figure 3:
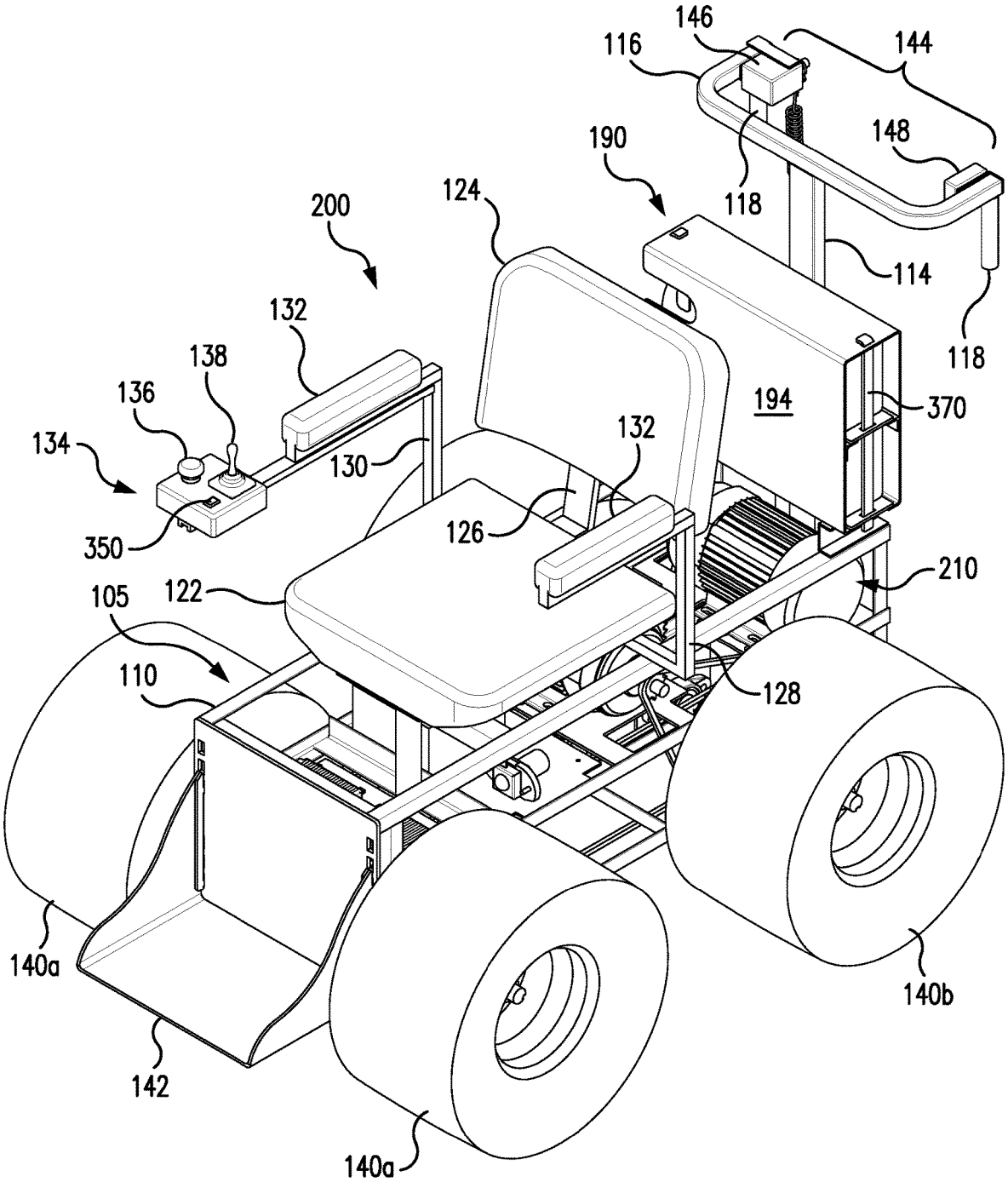
FIG. 3 is a perspective view of a an all wheel drive version of the powered wheelchair of the present invention.
Figure 4:
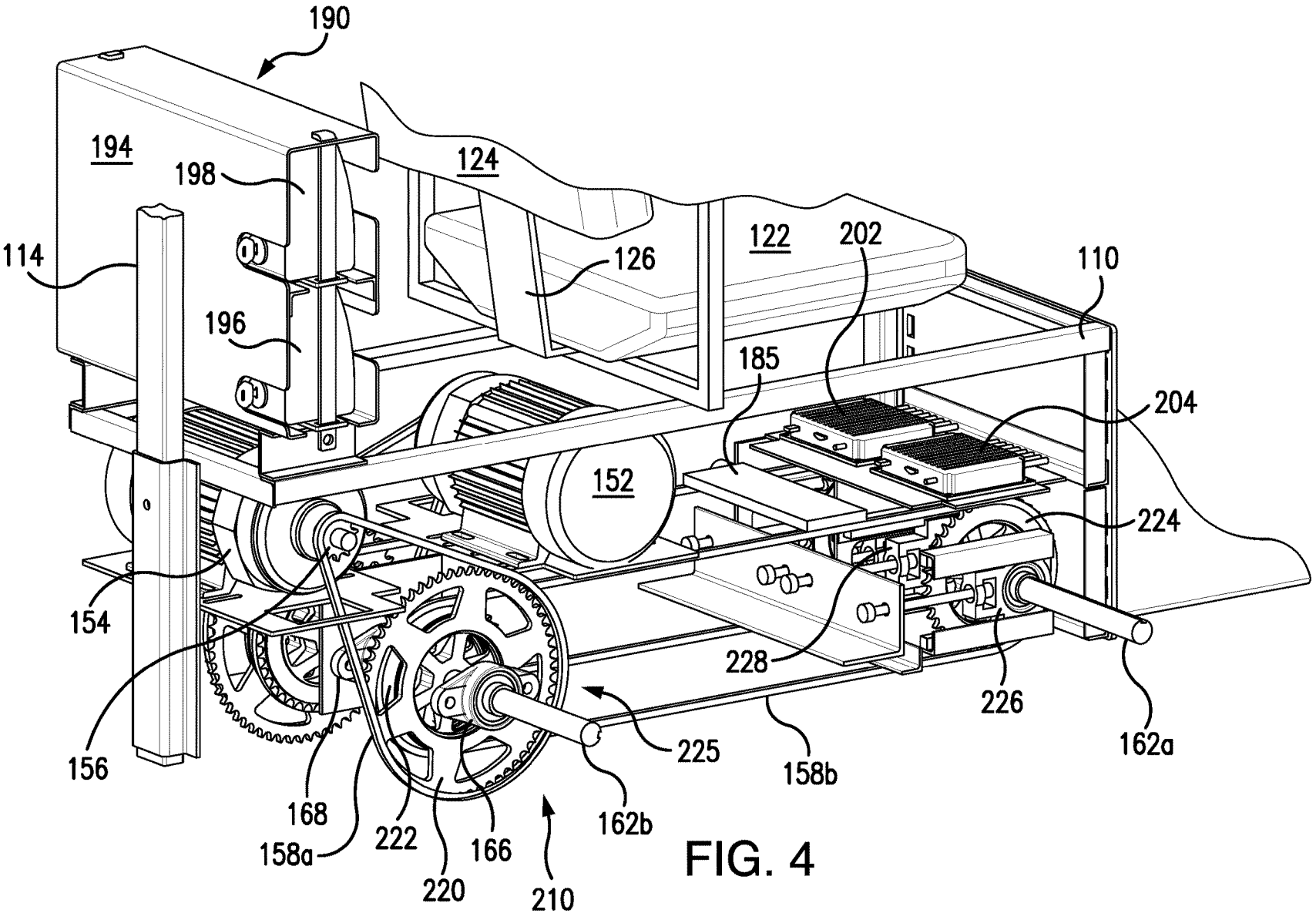
FIG. 4 is a cutaway view of the powered wheelchair showing the four wheel drive electric drive system.

Referring now to FIGS. 3 and 4, there is shown powered wheelchair 200 designed for operation on beach terrain and having all-wheel drive to better maneuver through soft sand and navigate steep inclines as may be encountered traversing sand dunes. The components of powered wheelchair 200 having like reference numerals to those of powered wheelchair 100 are identical elements common to both the two wheel drive and four wheel drive configurations.

Powered wheelchair 200 has a frame assembly 105 that includes a main frame 110 and a hand grip support frame 114 coupled on a rear longitudinal end of main frame 110. An occupant seat assembly 120 is mounted to an upper side of the main frame 110 adjacent the front end thereof. A foot support 142 is secured to the front end of the main frame 110 for use by the occupant seated in the occupant seat assembly 120. The occupant seat assembly 120 includes a seat bottom 122 supported on the main frame 110 and a seat back 124 positioned with respect to the seat bottom 122 by a seat back support member 126. Seat assembly 120 further includes a first arm rest support member 128 positioned on one side of the seat bottom 122 and a second arm rest support member 130 on the opposing side of the seat bottom 122. A pair of padded arm rests 132 are respectively mounted to the first and second arm rest support members 128 and 130. In addition to a padded arm rest 132 being mounted to the second arm rest support member 130, a first set of operating controls 134 is also mounted to the second arm rest support member 130 in proximity to the corresponding arm rest 132, at a position where the occupant's hand will be located to enable the occupant to control the wheelchair 200. The first set of operating controls 134 includes an emergency stop switch 136, a control select switch 350 and a two axis joystick 138. As previously discussed, control select switch 350 may be any type of two position switch, including a key operated switch. Switch 350 may also be located elsewhere on wheelchair 200, as well, such as adjacent to the controller 185.

The electric drive system 210 includes two high power brushless motors, a motor 152 drivingly coupled to a pair of drive wheels 140*a* and 140*b* on one respective side of the main frame 110, and a motor 154 drivingly coupled to another pair of drive wheels 140*a* and 140*b* on the opposing side of the main frame 110. Each drive wheel 140*a*, 140*b* has a wide and large diameter tire, as previously described for powered wheelchair 100, and providing the same advantages. Using all four of the wheels to propel powered wheelchair 200, however, provides additional advantages not unlike those provided by all-wheel drive automobiles. The all-wheel electric drive system 210 provides better maneuverability through soft sand and slippery terrain, and the ability to traverse steep inclines and off-road terrain.

Electric motors 152 and 154 of electric drive system 210 may also be high power brushless motors, such as the Unite BM1418ZXF750 W 48V 750 W motors. The brushless motors 152 and 154 include a 6:1 internal gear reduction that provides a maximum rotational speed of 467 rpm. and a torque of 15 N-m. Each of the electric motors 152 and 154 is coupled to a respective pair of the drive wheels 140*a* and 140*b* by a respective chain and sprocket transmission 225. The chain and sprocket transmissions 225 provides additional torque and corresponding wheel speed reduction using an 11 tooth motor sprocket 156 and 60 tooth first axle sprocket 220 coupled to a rear axle 162*b* that is drivingly coupled by a first drive chain 158*a*. Rear axle 162*b* also carries a second axle sprocket 222 and front axle 162*a* has a third axle sprocket 224 affixed thereto for rotation with the front axle 162*a*. Second axle sprocket 222 and third axle sprocket 224 are drivingly coupled by the second drive chain 158*b*, second and third axle sprockets 222 and 224 each carry the same number of teeth to provide a 1:1 speed ratio, so that the wheels 140*a* and 140*b* rotate synchronously.

The two chain and sprocket transmissions 225 each provide a speed reduction from the corresponding electric motor 152, 154 maximum rotational speed of 467 rpm to an 86 rpm maximum rotational speed of the axles 162*a*, driven by the first axle sprocket 220 (driven sprocket), and 162*b*, driven by the third axle sprocket 224 (driven sprocket). The wheels 140*a* and 140*b* are respectively connected to the corresponding axles 162*a* and 162*b* by wheel mounting plates respectively affixed to the axles 162*a* and 162*b* (not shown), but each is identical to the wheel mounting plate 164 shown in FIG. 2). The axles 162*b* on the two sides of the main frame 110, and the corresponding axles 162*a* respectively drivingly coupled thereto, are rotatably driven independent of one another so that the attached wheels can be rotated at different speeds to affect a turning maneuver. The two axles 162*b* on opposing sides of main frame 110 are rotatably supported by a pair of bearings 166 and 168. The bearings 166 and 168 are affixed to main frame 110 (not shown with respect to bearing 166 in order to clearly show other components of electric drive system 150). The two axles 162*a* on opposing sides of main frame 110 are rotatably supported by a pair of take-up bearings 226 and 228 that are slidably affixed to the main frame 110. The take-up bearings 226 and 228 utilize a screw jack-type adjustment mechanism to adjust the longitudinal position if the bearing, and the axle 162*a* therewith, as a means of adjusting the tension of second drive chain 158*b*.

The speed reduction, provided by the internal gear reduction of the motors and that of the chain and sprocket transmissions 210, results in a maximum speed of 5.4 mph, which maximum speed can be further limited by the control system 180. As in the case of powered wheelchair 100, it is important that the speed not be too great where an assistant is controlling the powered wheelchair 200, as the assistant operates the assistant operating controls 144 while walking behind the powered wheelchair 200.

Referring now to FIG. 6, there is shown an electrical block diagram for powered wheelchair 100, 200. Power for wheelchair 100, 200 is provided by the 48 V. battery 196, the output of which is coupled control system 180 through the main switch 230 via the coupling lines 232 and 234. Main switch 230 may be mounted on main frame 110 in proximity to the controller 185. The 48 V. input to control system 180 is represented by coupling lines 234, showing the 48 V. DC being supplied to both the emergency stop circuit 300 and the power supply 188 incorporated in the controller 185. Alternately, the power supply 188 may be a standalone device providing DC-DC conversion of the 48 V. DC input from battery 196 to the 5 V. DC and 24 V. DC supply voltages required by components of control system 180 or may be incorporated along with the controller 185 in one or both of the motor controllers 202, 204. Power supply 188 provides a 24 V. DC output to the emergency stop circuit as represented by the connection line 236, and provides outputs of 5 V. DC to each of the control processor 182, the left motor controller 202 and the right motor controller 204 as represented by the connection lines 238.

Control processor 182 is a microprocessor that in conjunction with the random access memory (RAM) 184 and the read only memory (ROM) 186 performs the control, testing and high level operations needed for the safe operation of powered wheelchair 100, 200. Control processor 182 interfaces with RAM 184 and ROM 186 through control and data busses represented by the connection lines 242 and 244. RAM 184 and ROM 186 may be implemented by any technology; in fact, control processor 182 may be a single packaged device incorporating the microprocessor, RAM 184 and ROM 186 therein. The human interfaces for control processor 182 include the control select switch 350, the joystick portion of the occupant controls 134 and the thumbwheels of the assistant controls 144, represented by the connection lines 246, 248 and 250, respectively. Select switch 350 is used to select which of the wheelchair speed/direction controls, occupant (joystick 138) or assistant (single axis thumbwheel controls 352, 354 or 356, 358 shown in FIGS. 8 and 9) is to be used as the source of the wheelchair speed/direction control input signals. The motor controllers incorporate status lights that indicate their operating status and many types of fault conditions. However, a further display (not shown) may be interfaced with controller 185 to provide feedback to an operator or servicer of the powered wheelchair 100, 200. An alarm buzzer (not shown) is also interfaced with control processor 182.

Control processor 182 interfaces with the motor controllers 202 and 204, providing commands with respect to motor speed and direction (forward/reverse) and receives operating status signals therefrom, the interfaces being represented by the connection lines 254 and 258. While two separate motor controllers 202 and 204 are shown, there are available individual motor controller devices that are capable of independently controlling two motors and such may be substituted for motor controllers 202 and 204. Additionally, such motor controller devices include a microprocessor, RAM and ROM that may be substituted for the control processor 182, RAM 184 and ROM 186 and if a sufficient power supply is included therein, such a controller may substitute for the controller 185 in addition to the motor controllers 202 and 204, providing that functionality in a single package.

The emergency stop circuit 300 is provided to interrupt the 48 V. DC power to the motor controllers 202 and 204 and thereby to the electric motors 152 and 154 and also to apply dynamic breaking to both electric motor 152 and electric motor 154. The 48 V. DC power supplied to emergency stop circuit 300 and through a main contactor is output to the left motor controller 202 and the right motor controller 204, as represented by the coupling lines 284. Fault signals output by the left motor controller 202 and the right motor controller 204 are coupled to emergency stop circuit 300, as represented by the respective coupling lines 298 and 338. Likewise, the coupling line 240 represents a control status interface between the emergency stop circuit 300 and the controller 185 by connections to the control processor 182. The control status interface provides status of emergency stop activation to the control processor 182 and provides initialization test status and control monitoring status performed by control processor 182 from control processor 182 to the emergency stop circuit 300. Each of the occupant controls 134 and assistant controls 144 includes an emergency stop switch that are separately interfaced with the emergency stop circuit 300, as represented by the respective coupling lines 252 and 256; either one of which is able to initiate an emergency stop of the powered wheelchair 100, 200 at any time during its operation.

The brushless motors 152 and 154 have windings that are wound to generate a three phase rotating field when supplied with appropriately phased currents to those windings. The motor controllers 202 and 204 generate the three phase currents supplied to the brushless motors 152 and 154 using MOSFET, or other technology switching devices, to create the three phase drive currents required by the motors. Each of the motor controllers 202 and 204 monitor the status of those switching devices and output a switched signal representing the status of those devices. Thus closed switch contacts, or an electronic equivalent thereto, between a pair of terminals represents properly operating switching devices (a no fail condition). Whereas, an open condition between those terminals represents a failure condition of any of the switching devices used to power the corresponding motor. The open/closed switched signal defines the no fault/fault signal coupled to emergency stop circuit 300 from each of the motor controllers 202 and 204, as represented by the respective coupling lines 298 and 338.

Accordingly, left motor controller 202 is electrically coupled to the left motor 152 by the conductors 272, 274 and 276 for supplying the drive current thereto. Similarly, the drive current to right motor 154 is supplied by the right motor controller 204 via the conductors 260, 262 and 264. The connections between the left motor controller 202 and the left motor 152 represented by the conductors 272, 274 and 276 are taped by the conductors 282, 280 and 278, respectively. Likewise, the connections between the right motor controller 204 and the right motor 154 represented by the conductors 260, 262 and 264 are taped by the conductors 270, 268 and 266, respectively. The conductors 282, 280 and 278 and the conductors 270, 268 and 266 are respectively coupled to emergency stop circuit 300 to apply dynamic breaking to the left motor 152 and right motor 154 when an emergency stop condition is initiated.

Figure 7:
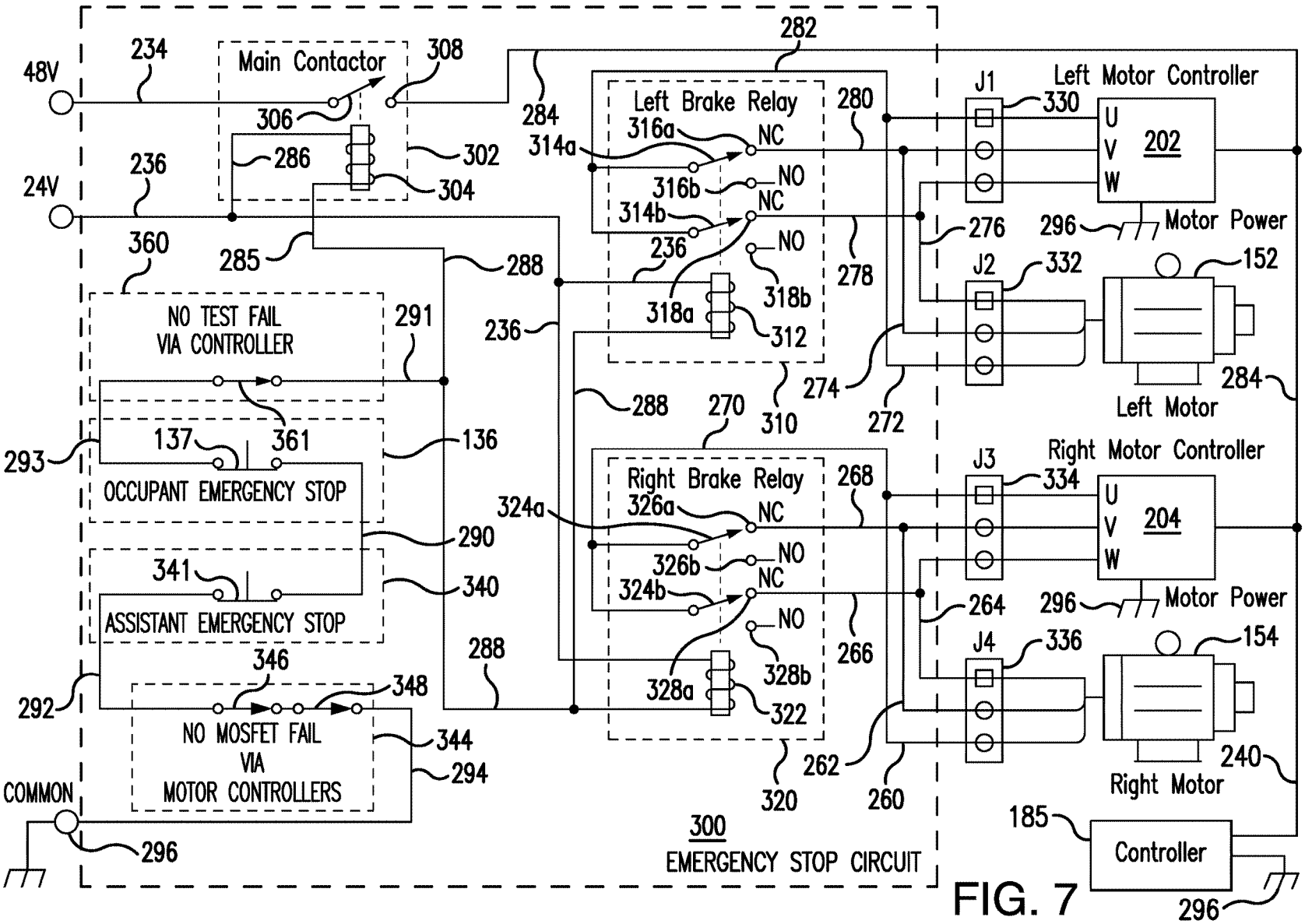
FIG. 7 is a schematic diagram of the emergency stop circuit of the powered wheelchair.

The emergency stop circuit 300, as shown in FIG. 7, receives a 48 V. DC input provided by the connection line 234, and a 24 V. DC input provided by the connection line 236, as well as having a common or ground connection 296. The 48 V. DC power is supplied via the main contactor 302 to the motor controllers 202 and 204, by the conductors 284 for use in powering the electric motors 152 and 154, and supplied to the controller 185 by the conductor 240 as a signal that the emergency stop operation has not been initiated. The 48 V. return path from those devices is via the common connection 296. The main contactor 302 has a movable contact 306 to which the 48 V. DC power on line 234 is connected. Movable contact 306 connects to the terminal 308 responsive to the coil 304 being energized. Terminal 308 is connected to the connection line 284. The exemplary electromechanical main contactor 302, as well as the other electromechanical switching devices illustrated herein may be replaced with high current solid state switching devices without departing from the inventive concepts disclosed herein.

As previously described, the 24 V. DC power is derived from the 48 V. DC power in power supply 188 and distributed to the main contactor coil 304, the left brake relay coil 312 and the right brake relay coil 322, by the conductor 236. One end of the main contactor coil 304 is connected to the 24 V. supply line 236 by the conductor 286 and the opposing end of coil 304 is connected to the return line 288 by the conductor 285. The return line 288 is connected to a set of series connected, normally closed contacts, each representing a condition or command that may initiate the emergency stop operation. The emergency stop operation disconnects the 48 V. DC power from the two motor controllers 202 and 204, and connects the windings of each respective motor together as the means of dynamically breaking the rotation of each of the motors using the generated counter electromotive force (EMF) of the motors to slow rotation of the motors to a stop.

The left and right brake relays 310 and 320 are double pole, double throw (DPDT) relays. In FIG. 7, main contactor 302, left brake relay 310 and right brake relay 320 are illustrated in the condition of the emergency stop function having been initiated. Thus, the movable contact 306 of the main contactor 302 is shown in an open condition and the movable contacts 314*a* and 314*b* of the left brake relay 310, and the movable contact 324*a* and 324*b* of the right brake relay 320 are shown in their normally closed (NC) position.

The movable contacts 314*a* and 314*b* of the left brake relay 310 are both connected to the conductor 282 that is connected to the conductor 272 which connects a first motor winding lead connected to the connector 332 to a first motor controller output drive lead connected to the connector 330. The first normally closed terminal 316*a* is connected to the conductor 280 that is in turn connected to the conductor 274 which connects a second motor winding lead connected to the connector 332 to a second motor controller output drive lead connected to the connector 330. The second normally closed terminal 318*a* is connected to the conductor 278 which is connected to the conductor 276 that connects a third motor winding lead connected to the connector 332 to a third motor controller output drive lead connected to the connector 330. Hence, when the left brake relay is de-energized, the first, second and third motor winding leads are all connected together ("shorted to one another") through the movable contacts 314*a* and 314*b* and the NC terminals 316*a* and 318*a*. When the relay coil 312 is energized during normal operation of the powered wheelchair 100, 200, each of the movable contacts 314*a* and 314*b* is respectively connected to the normally open (NO) terminals 316*b* and 318*b*. As the NO terminal 316*b* and 318*b* are not connected to any wiring, the normal connections between the motor winding leads and the motor controller output drive leads are left undisturbed.

In a like manner, the movable contacts 324*a* and 324*b* of the right brake relay 320 are both connected to the conductor 270 that is connected to the conductor 260 that connects a first motor winding lead connected to the connector 336 to a first motor controller output drive lead connected to the connector 334. The first normally closed terminal 326*a* is connected to the conductor 268 which is connected to the conductor 262 that connects a second motor winding lead connected to the connector 336 to a second motor controller output drive lead connected to the connector 334. The second normally closed terminal 328*a* is connected to the conductor 266 that is connected to the conductor 264 which in turn connects a third motor winding lead connected to the connector 336 to a third motor controller output drive lead connected to the connector 334. Hence, when the right brake relay is de-energized, the first, second and third motor winding leads are all shorted together through the movable contacts 324*a* and 324*b* and the NC terminals 326*a* and 328*a*. When the relay coil 322 is energized during normal operation of the powered wheelchair 100, 200, each of the movable contacts 324*a* and 324*b* are respectively connected to the normally NO terminals 326*b* and 328*b*. As the NO terminals 326*b* and 328*b* are not connected to any wiring, the normal connections between the motor winding leads and the motor controller output drive leads are left undisturbed here also.

Since the 24 V. return path for main contactor coil 304, left brake rely coil 312 and right brake relay coil 322. is in series with a set of series connected normally closed switch contacts, it only takes the opening of any one of the contacts to interrupt the current path and de-energize main contactor 302, left brake rely 310 and right brake relay 320; initiating the emergency stop condition. The set of series connected normally closed switch contacts represents the absence of certain events or control operations, which includes failure of certain tests performed by the controller 185 provided by a switch function 360, operation of the occupant emergency stop switch 136, operation of the assistant emergency stop switch 340, and failure of the MOSFET switching devices of the two motor controllers 202 and 204 provided by the switch function 344. The set of series connected normally closed switch contacts starts with the conductor 291 coupling the return lines 288 the normally closed switch function 361 provided by the controller 185, which closed switch contact represents a "no test fail" condition. A failure of an initialization test or monitored control operation test performed by controller 185 results in the switch function 361 switching to an open condition and thereby interrupts the 24 V. return path for main contactor coil 304 and the two brake relay coils 312 and 322 to the common terminal 296, and in so doing initiates the emergency stop condition. To reset the system, the main switch 239 must be cycled by switched it off and then on again.

A conductor 293 connects the switch function 361 to the normally closed switch contact 137 of the occupant emergency stop switch 136 and a conductor 290 connects the normally closed switch contact 137 to the normally closed switch contact 341 of the assistant emergency switch 340. Accordingly operation of either one of emergency stop switch 136 or 340, at any time, results in opening the return path to the common terminal 296 to initiate the emergency stop condition, regardless to which speed/steering controls, occupant or assistant, are selected by the switch 350. The series path is continued by the conductor 292 the connects the normally closed switch contact 341 to the normally closed switch function 346 of the left motor controller 202, that in turn is connected in series to the normally closed switch function 348 of the right motor controller 214. Together, both normally closed switch functions 346 and 348 represent the "no MOSFET failure condition 360 of the motor controllers 202 and 204. A conductor 294 connects the normally closed switch function 348 to the common terminal 296 to complete the 24 V. return path for main contactor coil 304 and brake relay coils 312 and 322. It can therefore be seen that a failure condition of the MOSFET switching devices or either of the motor controllers 202 or 204. results in opening of the corresponding switch function 346 or 348 to initiate the emergency stop condition. A brushless motor controller such as the Roboteq HBL2360 may be utilized for the left and right motor controllers 202 and 204, and incorporates the MOSFET failure output switch function capability Turning now to FIGS. 8 and 9, there is shown, the assistant controls for controlling the speed and direction of the powered wheelchair 100, 200 when such is selected by the control select switch 350, as previously described. The right hand controls 146 includes the assistant emergency stop switch 340 which includes a lanyard 342 for attachment to the assistant that is walking behind the powered wheelchair 100, 200. The lanyard operated stop switch 340 allows the assistant to manually activate the emergency stop function and provides an automatic emergency stop activation if the assistant stumbles or has released the hand grips 118 and drifts too far away from the powered wheelchair 100, 200. A commercially available emergency cutoff switch with lanyard having the designation SeaDogLine 420488 may be used for the assistant's emergency stop switch and lanyard 340, 342.

The assistant controls comprise the right hand controls 146 and the left hand controls 148 to control the wheelchair movement using two single axis thumbwheels 352 and 354; 356 and 358. One such single axis thumbwheel usable for thumbwheels 352 and 354; 356 and 358 is the commercially sold APEM TW09RED12 available from ERMEC SL of Barcelona, Spain. This thumbwheel incorporates three important safety features. First, these thumbwheels have a spring return to their center position. The center position corresponds to a stopped wheel command so the wheelchair is stopped if the thumbwheels are released. Second, the valid thumbwheel output range is 1V to 4V with the 5V DC supply from power supply 188. If the thumbwheel is disconnected, shorted to ground, or shorted to the +5V supply, these errors can be detected since they are outside the valid signal range of 1V to 4V. Third, the thumbwheel has redundant dual position sensors, each with its own output. One of the outputs has an output voltage that ramps up, while the other sensor output voltage ramps down for the same displacement of the thumbwheel actuator. Thus, the output of one sensor of the thumbwheel, when the thumbwheel actuator is displaced from end-to-end, produces an output that ramps up from 1 V. to 4 V. While at the same time, the output of the other sensor produces an output that ramps down from 4 V. to 1V. If the thumbwheel has a sensor failure that results in a valid, but incorrect, voltage on the output of one sensor, the error can be detected by subtracting the center position voltage (2.5 V.) from both sensor outputs and summing the two resulting values. The sum of those values would be zero if the sensors are operating properly, and since it is unlikely that a sensor error would still produce the expected zero result, the control processor 182 of control system 180 is able to detect the error. If the thumbwheel has a sensor failure that results in a valid, but incorrect, voltage on the one output, the error can be detected since it is unlikely that the error would produce the corresponding inverted value on the other sensor output. As one of the thumbwheels 352 and 354; 356 and 358 is located adjacent to each of the hand grips 118, the single axis thumbwheel allows the assistant to control each thumbwheel with their thumb while still maintaining a hold on the hand grips 118.

Figure 8:
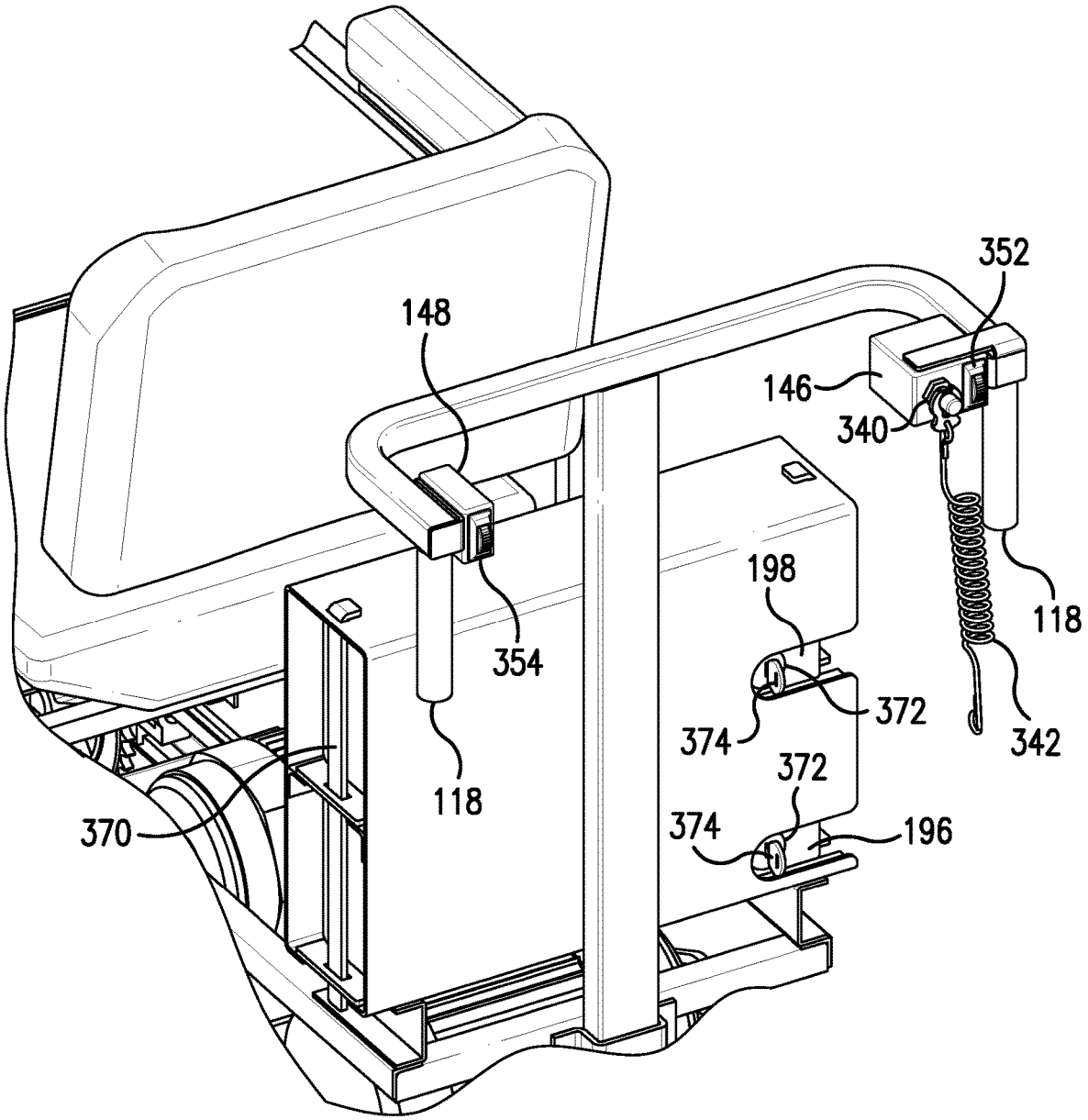
FIG. 8 is a is a cutaway view of the powered wheelchair showing the assistant controls therefore.

In a first version of the assistant controls, shown in FIG. 8, the left thumbwheel 354 determines the velocity of the left wheel(s) while the right thumbwheel 352 determines the velocity of the right wheel(s). This is referred to as the wheel speed control configuration. Both thumbwheels 352 and 354 are mounted vertically such that their actuators rotate upward/downward to command forward/reverse directions. The greater the displacement from center, the greater the speed in the respective direction. In this configuration the wheelchair is propelled in a straight line when the actuators, which may be a tabbed or un-tabbed wheels, of thumbwheels 352 and 354 are displaced equally in the same direction. That results in the drive wheels on both sides of the powered wheelchair 100, 200 turning at the same speed and rotating in the same direction. Turning of the wheelchair is achieved by displacing the actuators of the two thumbwheels 352 and 354 differentially, so that the drive wheel(s) on the left side of wheelchair 100, 200 and the drive wheel(s) on the right side of wheelchair 100, 200 rotate at different speeds and/or directions. Thus, it is possible for the powered wheelchair 100, 200 to execute zero radius turns by maximizing the difference in displacement of the two actuators of thumbwheels 352 and 354.

Figure 9:
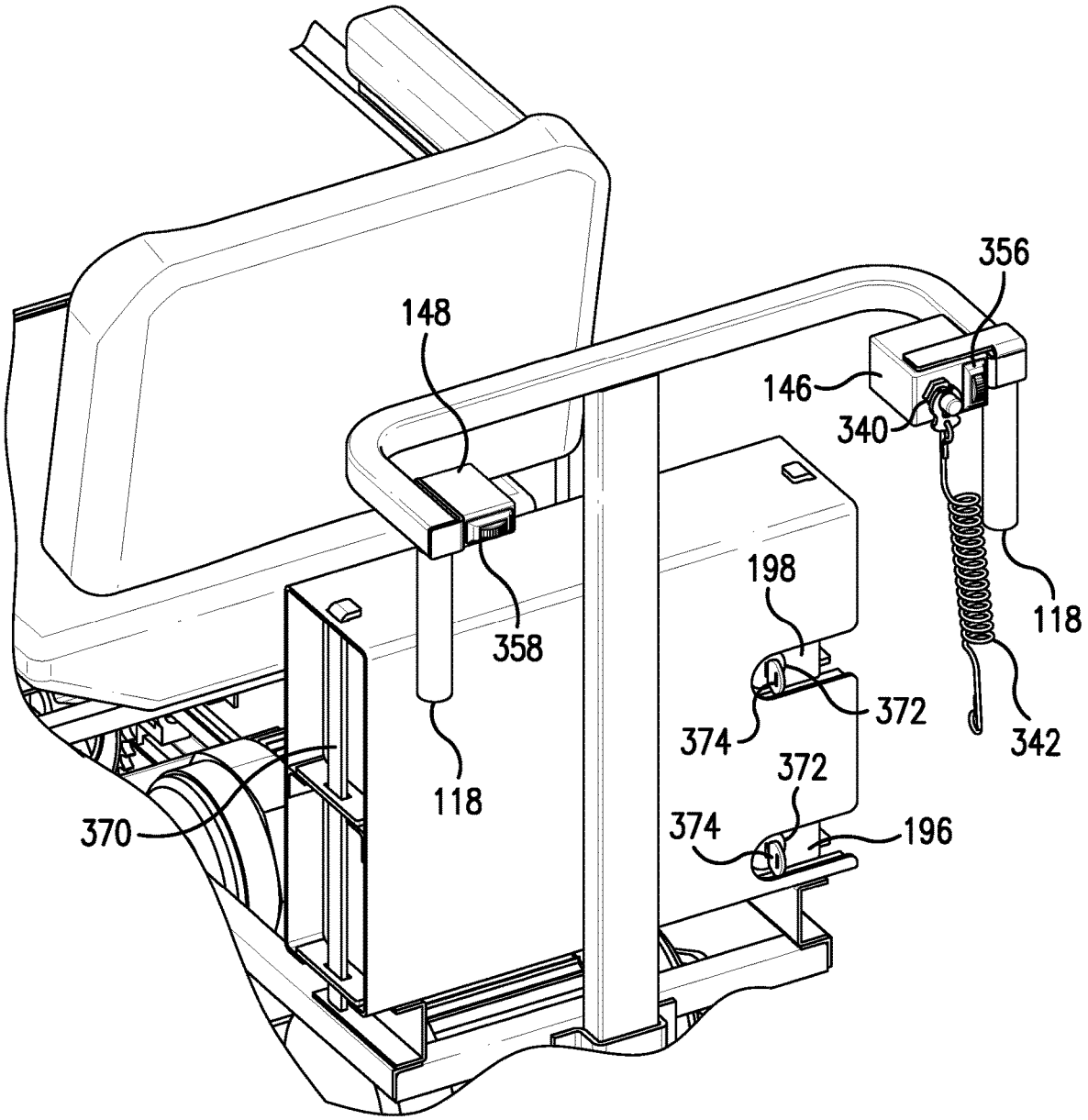
FIG. 9 is a cutaway view of the powered wheelchair showing an alternate configuration of the assistant controls.

The second version of the assistant controls is shown in FIG. 9. This control configuration uses the left thumbwheel 358 to determine the turn command and the right thumbwheel 356 to determine the wheelchair forward/reverse speed. This is referred to as the turn/speed configuration. In this configuration the left turn command thumbwheel 358 is mounted horizontally such that the actuator moves left/right to command left/right turns. Based on the direction and amount of displacement of the thumbwheel actuator, as indicated by the output voltages of the sensors of thumbwheel 358, the controller 185 computes the differential speed and/or direction commands that are output to the motor controllers 202 and 204 to execute a turn. The greater the displacement of the actuator, the sharper the turn, so that hereto, a zero radius turn can be executed. The right hand thumbwheel 356 is mounted vertically, like the thumbwheels 352 and 354 of the first control configuration shown in FIG. 8. Thumbwheel 356 rotates upward to correspond with a forward speed command and downward to correspond with a reverse speed command. The amount and direction of displacement of the actuator of thumbwheel 356 from the center position determines to the speed the drive wheel(s) are rotated in the corresponding direction.

Figure 10:
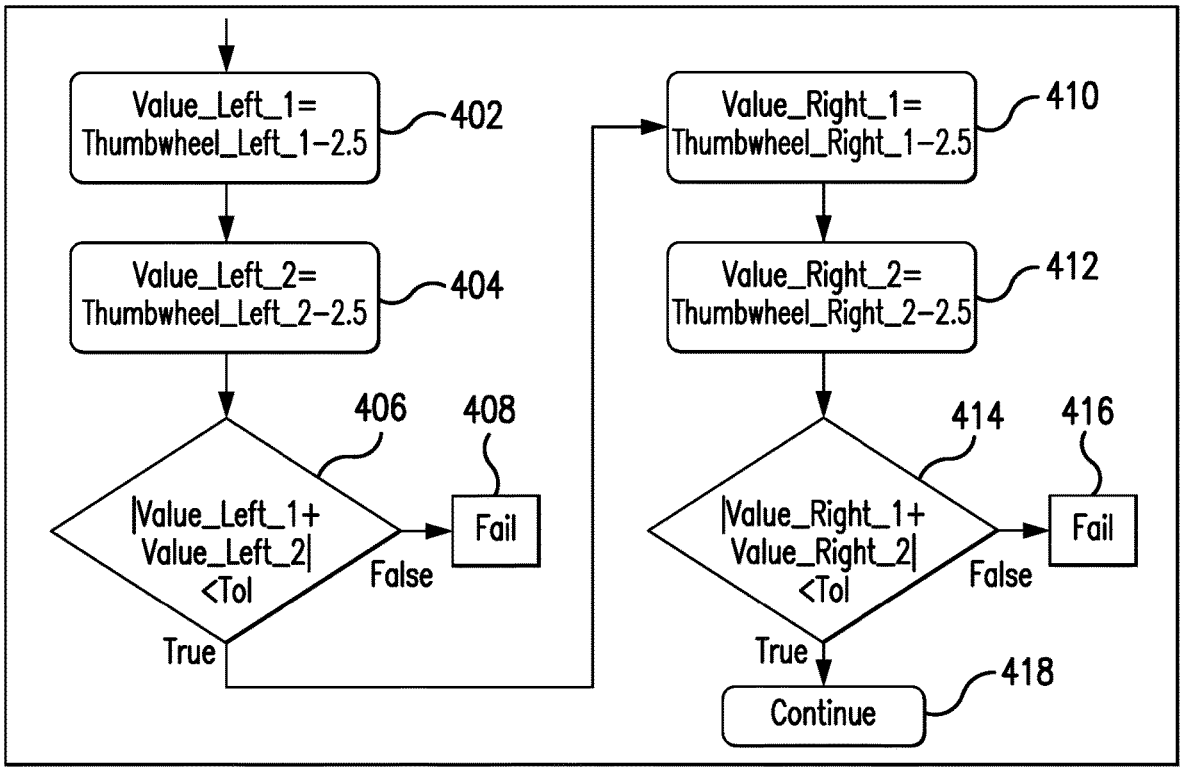
FIG. 10 is a flow chart of a first initialization test of controls for the powered wheelchair.

Power-on safety checks are completed prior to enabling the motors 152 and 154 of powered wheelchair 100, 200. The first safety check ensures that the dual sensors in each thumbwheel 352 and 354; 356 and 358 are consistent. Referring to FIG. 10, there is shown a block diagram of the first initial sensor output tests. The sensor values for each sensor are read using the A/D converter that normally reads the sensor values during normal operations. In block 402 the first sensor for the left thumbwheel (or left/right joystick axis) output is read, the center position voltage value 2.5 is subtracted from the read value and the result is stored as the Value_Left_1 value. Then the flow moves to block 404 where the second sensor output for that thumbwheel (joystick axis) is read, the center position voltage value 2.5 is subtracted from the read value and the result is stored as the Value_Left_2 value. The flow then moves to the decision block 406 where it is determined whether the absolute value of the sum of the two stored values Value_Left_1 and Value_Left_2 are within a tolerance range. Since one sensor output is oppositely ramped with respect to the other, after subtracting the center position voltage from both sensor output voltages, the absolute value of the sum of the two sensor outputs should be zero, within the sensor output tolerance range. If the absolute value of the sum is outside the tolerance range, the flow moves to the failure block 408 where the controller 185 halts the testing and activates the alarm buzzer. The controller 185 will not proceed with enabling the motors and requires a power reset to repeat the initialization process.

If, however, the absolute value of the sum of the two stored values Value_Left_1 and Value_Left_2 are within the tolerance range, the flow moves to block 410 where the first sensor for the right thumbwheel (or forward/rearward joystick axis) output is read, the center position voltage value 2.5 is subtracted from the read value and the result is stored as the Value_Right_1 value. The flow then moves to block 412 where the second sensor output for that thumbwheel (joystick axis) is read, the center position voltage value 2.5 is subtracted from the read value and the result is stored as the Value_Right_2 value. From block 412, the flow moves to the decision block 414 where it is determined whether the absolute value of the sum of the two stored values Value_Right_1 and Value_Right_2 are within a tolerance range, as was done in decision block 406. If the absolute value of the sum is outside the tolerance range, the flow moves to block 416, indicating a failure, and in which case the controller 185 would not proceed with enabling the motors and activates the alarm buzzer as discussed above. If the absolute value of the sum is within the tolerance range, the flow moves to the block 418 where the initialization routine moves on to the next test.

Figure 11:
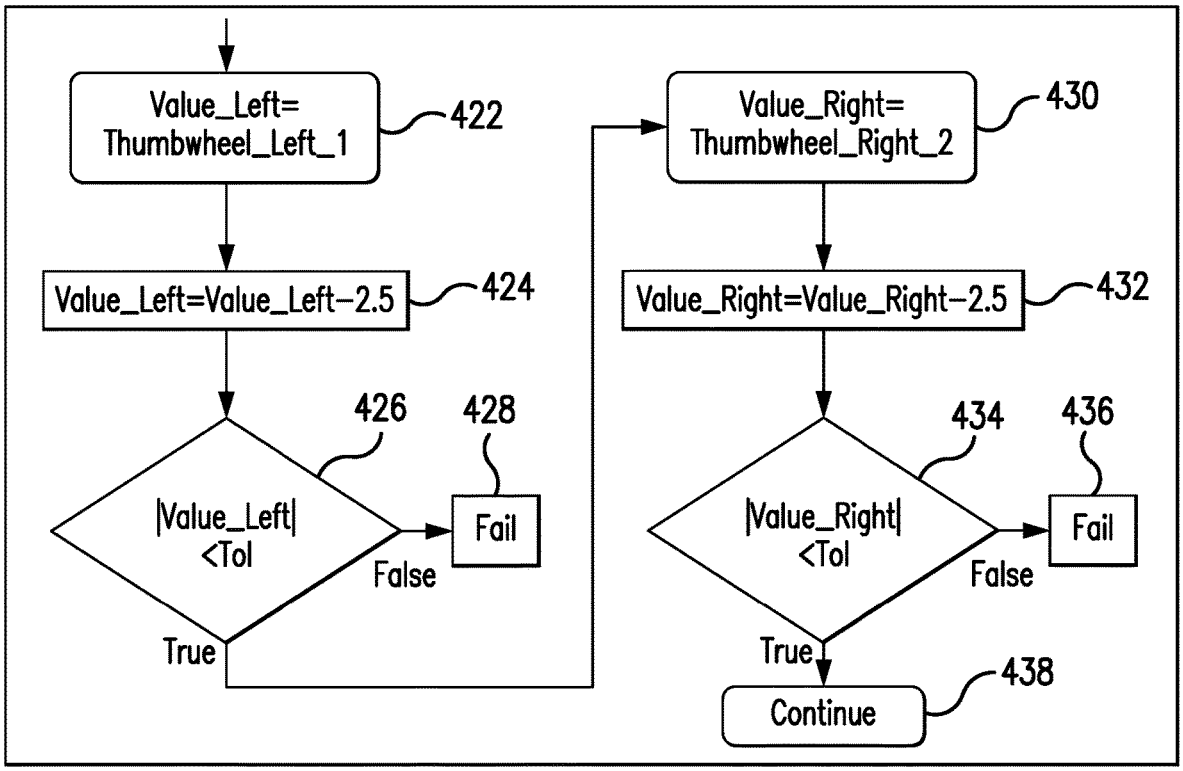
FIG. 11 is a flow chart of a second initialization test of controls for the powered wheelchair.

The second startup safety test ensures that both thumbwheels (both axes of the joystick) are at their default center location within a specified tolerance. The centered location ensures that the thumbwheels (joystick axes) are not stuck in a position requesting motion. The thumbwheel sensor output at the center position is 2.5V with a 5V supply. In FIG. 11, a block diagram of the second initial sensor output tests are shown. The flow begins in block 422 where one sensor for the left thumbwheel (or left/right joystick axis) output is read and stored as the Value_Left value, and the flow moves to block 424. In block 424 the expected center position voltage value 2.5 is subtracted from the stored value, Value_Left, and the result saved as the Value_Left variable. The flow then moves to decision block 426 where it is determined if the absolute value of the stored value, Value_Left, is with the tolerance range for the device, which will be zero plus/minus the tolerance. If it is not, the flow moves to the failure block 428, where the test halts and the alarm buzzer is activated.

If, on the other hand, the result of decision block 426 is within the tolerance range, the flow continues to block 430 for testing the centering of the right thumbwheel (the other joystick axis. In block 430, where one sensor output is read and stored as the Value_Right value, and the flow moves to block 432. In block 432 the expected center position voltage value 2.5 is subtracted from the stored value, Value_Right, and the result saved as the Value_Right variable. The flow then moves to decision block 434 where it is determined if the absolute value of the stored value, Value_Right, is with the tolerance range for the device, here again zero plus/minus the tolerance. If it is not, the flow moves to the failure block 436, the test halts and the alarm buzzer is activated. Otherwise, the flow moves to block 438 where the initialization routine moves on to the next test.

These aforedescribed power-on safety checks are performed on the optional occupant joystick 138 if it is enabled by the control select switch 350 at the time the main switch 230 is turned on. Once the system has been powered on, the control selection will not be changed by subsequent operation of switch 350. The occupant joystick 138 is a two axis joystick with dual sensors on each axis. The power-on safety tests are performed where the two axes of the joystick correspond to the two thumbwheels.

If either of the power-on safety tests fails on an enabled assistant's thumbwheels or enabled rider's joystick, the software halts and an alarm buzzer is activated. If the power-on tests failed due to a thumbwheel or the joystick being held off center, the thumbwheel or joystick must be released and power cycled to reset and start the wheelchair. The wheelchair motive power is enabled only after all power-on tests have been successfully completed.

After the initial power-on safety checks are completed, the software enters a continuous loop evaluating thumbwheel or joystick commands. Each time the thumbwheel/joystick sensor values are read, the dual sensors in each thumbwheel or joystick are tested to ensure consistency, performing the same test steps as in the initialization test in FIG. 10. If the consistency check fails, an emergency stop command is executed and the alarm buzzer is activated. If the consistency check passes, the sensor values are evaluated to ensure they are in the valid output range of 1 V. to 4 V.

Figure 12:
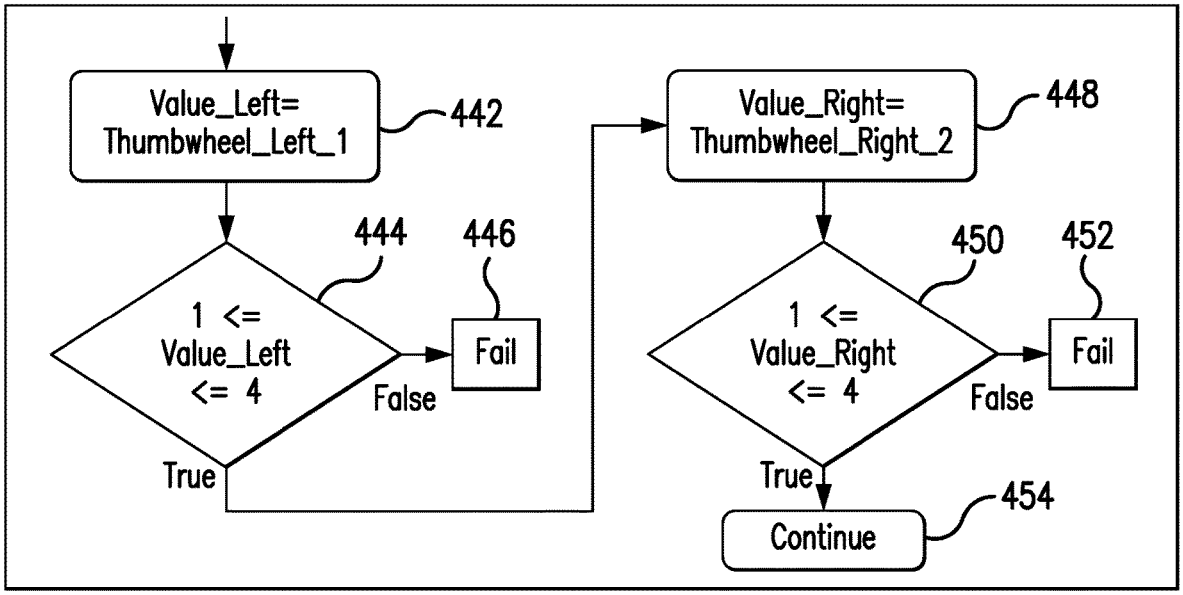
FIG. 12 is a flow chart of a consistency test of controls for the powered wheelchair.

In FIG. 12, there is shown a block diagram of the sensor output validity check. The flow starts in block 442 where one sensor output for the left thumbwheel (left/right axis of the joystick) is read and stored as the Value_left value. The flow then moves to decision block 444 where the value stored as Value_Left is determined whether it is within the valid output range of 1 V. to 4 V. If it is not, the flow moves to the fail block 446 where an emergency stop command is executed and the alarm buzzer is activated. Otherwise, the flow moves on to block 448. In block 448, one sensor output for the right thumbwheel (forward/rearward axis of the joystick) is read and stored as the Value_Right value. The flow then moves to decision block 450 where the value stored as Value_Right is determined whether it is within the valid output range of 1 V. to 4 V. Here again, it this test fails, the flow moves to the failure block 452 where an emergency stop command is executed and the alarm buzzer is activated. If the sensor output proves to be valid, the flow moves to block 454, indicating that both safety checks have passed and the sensor values of the thumbwheels or joystick are valid and are then used to determine the wheelchair movement, then the these test repeated continually.

In the turn/speed control configuration of FIG. 9, one thumbwheel 356 controls speed and the other thumbwheel 358 controls the turn rate. When the actuator of the speed thumbwheel 356 is centered, both wheel motors 152 and 154 are stopped. While the actuator of the turn thumbwheel 358 is centered, the speed thumbwheel 356 produces straight forward or reverse motion. That is, the drive wheels 140; 140*a*, 140*b* on the two sides of the wheelchair 100, 200 rotate at the same speed. When the actuator of the speed thumbwheel 356 is moved upward the wheelchair 100, 200 moves forward. When the actuator of the speed thumbwheel 356 is moved downward the wheelchair 100, 200 moves backwards. The wheelchair speed is determined by the distance the actuator of the speed thumbwheel 356 is displaced from its center position.

Figure 13:
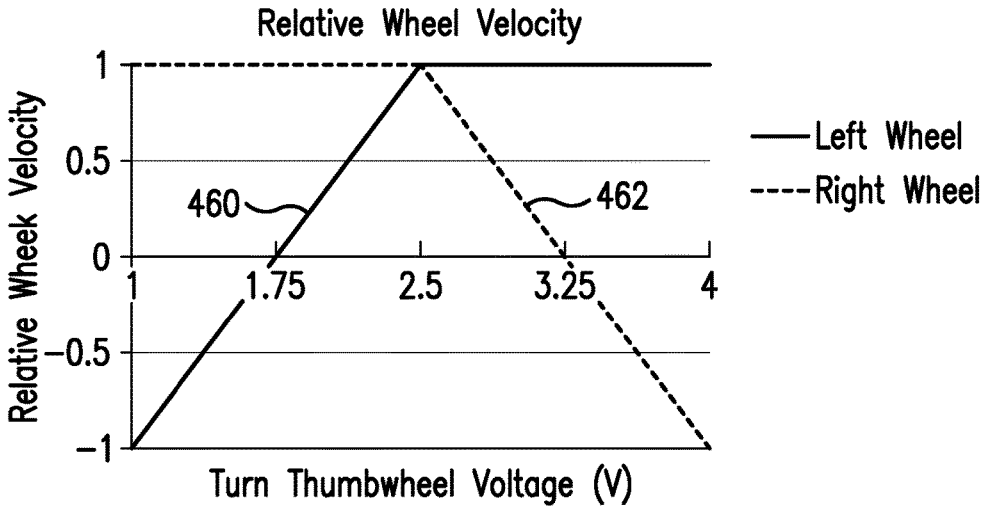
FIG. 13 is a graph of the relative wheel velocity commands of the single axis thumbwheel controls for the powered wheelchair in a turn/speed control configuration.

The actuator of the turn thumbwheel 358 is moved left or right to turn the wheelchair 100, 200 accordingly. The distance the actuator of the turn thumbwheel 358 is displaced determines the radius of the wheelchair turn while the actuator's position of the speed thumbwheel 356 determines the speed of the fastest drive wheel(s). The extreme thumbwheel actuator positions result in the wheelchair turning at one spot, i.e. a zero radius turn. At the extreme turn thumbwheel actuator positions, the drive wheel(s) on one side of wheelchair 100, 200 will be set to a +1 relative speed and the drive wheel(s) on the other side will be set to a −1 relative speed. The absolute wheel speeds are determined by the speed thumbwheel 356 actuator position. If the actuator position of the speed thumbwheel 356 is requesting a 2 mph speed, the drive wheel(s) on one side of wheelchair 100, 200 will move forward at 2 mph and the drive wheel(s) on the other side will move in reverse direction at 2 mph. The wheel speed and direction commands are determined based on left/right actuator direction of the turn thumbwheel 358 and forward/reverse actuator direction of the speed thumbwheel 356. FIG. 13 illustrates the relative wheel velocity commands. The absolute wheel speeds are determined by multiplying the relative wheel velocity by the speed thumbwheel velocity.

Figure 14:
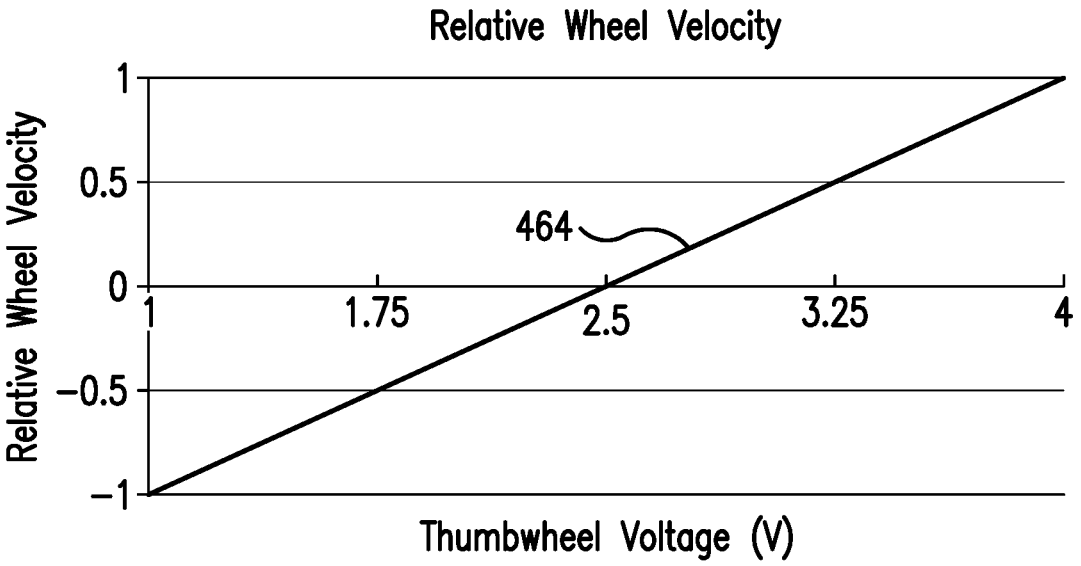
FIG. 14 is a graph of the relative wheel velocity commands of the single axis thumbwheel controls for the powered wheelchair in a wheel control configuration.

In the wheel control configuration of FIG. 8, the relative position of the actuators each thumbwheel 352 and 354 determines the speed and direction of the drive wheel(s) on the corresponding side of wheelchair 100, 200, as represented graphically in FIG. 14. When the actuator of thumbwheel 356 is moved upward of its center position, the drive wheel(s) on the corresponding side of wheelchair 100, 200 moves forward at a speed that increases with the distance the thumbwheel's actuator is moved from its center location. When the actuator of the thumbwheel is moved downward from its center position, the drive wheel(s) on the corresponding side of wheelchair 100, 200 moves in reverse at a speed that increases with the distance the thumbwheel's actuator is moved from its center location. Maximum acceleration and deceleration rates are programmed to make a smooth change in speed and minimize unintended violent speed changes due to accidental movement of the thumbwheel actuators. The maximum deceleration rate is greater than the maximum acceleration rate since a fast stop may be required.

Figure 15:
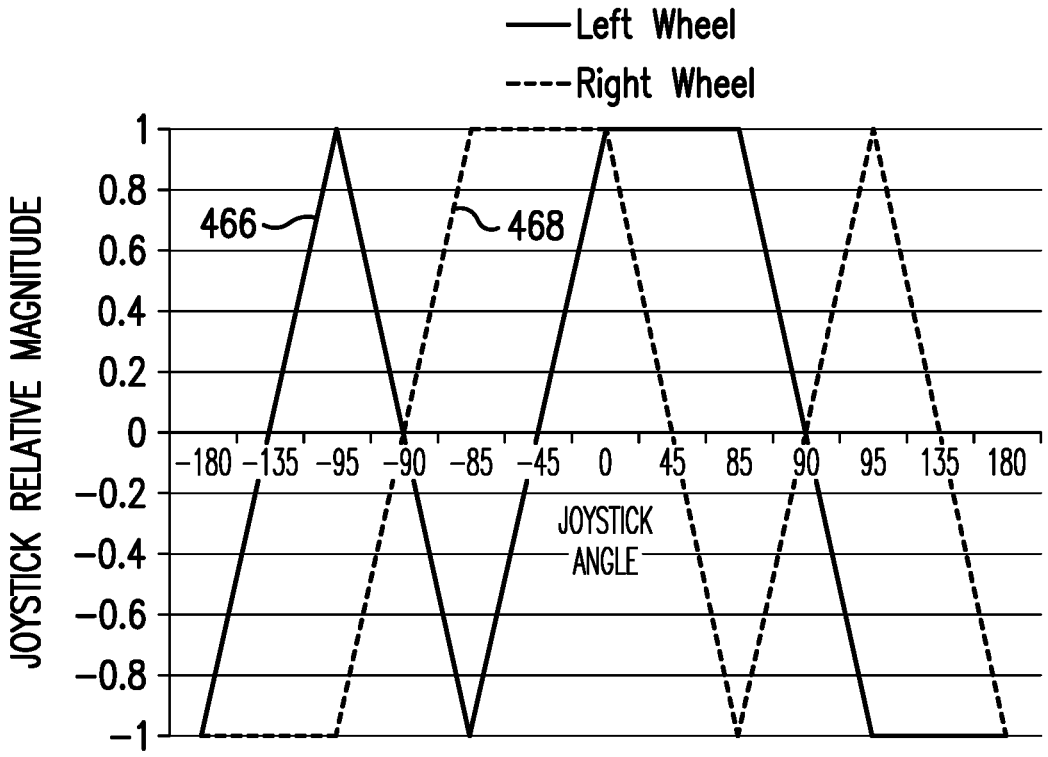
FIG. 15 is a graph of the relative wheel velocity commands of the joystick control for the powered wheelchair.

When the occupant joystick 138 is active, the wheel velocity commands are determined by the occupant joystick position. The occupant joystick 138 produces a left/right position and forward/rearward position. The left/right output is 1V at the left most position and 4V at the right most position. Similarly, the forward/rearward output is 1V at the rear most position and 4V at the forward most position. The left/right and forward/rearward joystick values are converted into a joystick angle and magnitude. The joystick angle ranges from −180 to 180 degrees and determines the relative wheel speed that in turn determines the turn radius. The magnitude determines the absolute wheel speeds. Angles between −90 and +90 correspond to forward movement. Angles between −90 to −180 and +90 to +180 correspond to reverse movement. Negative joystick angles correspond to left turns and positive angles correspond to right turns. The relative wheel velocities are a function of the joystick angle are shown in FIG. 15.

The descriptions above are intended to illustrate possible implementations of the present invention and are not restrictive. While this invention has been described in connection with specific forms and embodiments thereof, it will be appreciated that various modifications other than those discussed above may be resorted to without departing from the spirit or scope of the invention. Such variations, modifications, and alternatives will become apparent to the skilled artisan upon review of the disclosure. For example, functionally equivalent elements may be substituted for those specifically shown and described, and certain features may be used independently of other features, and in certain cases, particular locations of elements may be reversed or interposed, all without departing from the spirit or scope of the invention as defined in the appended Claims. The scope of the invention should therefore be determined with reference to the description above, the appended claims and drawings, along with their full range of equivalents.

What is being claimed is:

1. A powered wheelchair for beach terrain, comprising:

a frame assembly including a longitudinally extended main frame and a hand grip support frame extending from an end of said main frame in a direction transverse with respect to the longitudinal direction of said main frame;

an occupant seat assembly mounted to said main frame;

an electric drive system mounted to said main frame;

a plurality of wheels rotatably coupled to said main frame, at least two of said plurality of wheels on opposing sides of said main frame being drivingly coupled to said electric drive system;

a portable power source mounted to said main frame; and a control system mounted to said main frame and electrically coupled to said portable power source and said electric drive system, said control system including a first set of operating controls disposed in proximity to said occupant seat assembly for use by an occupant thereof and a second set of operating controls disposed in proximity to said hand grip support frame for use by an assistant operator, said second set of operating controls including a pair of single axis thumbwheel controls respectively positioned adjacent a pair of hand grips coupled to said hand grip support frame to be operable by the assistant operator while said pair of hand grips is being held by the assistant operator.

2. The powered wheelchair of claim 1, where said control system includes a control processor and a switch coupled to said control processor for selectively enabling only one of said first and second sets of operating controls.

3. The powered wheelchair of claim 1, where said control system includes an emergency stop circuit operated by either of a first emergency stop switch disposed in proximity to said occupant seat assembly for use by the occupant and a second emergency stop switch disposed in proximity to said hand grip support frame for use by an assistant operator.

4. The powered wheelchair of claim 1, where said electric drive system includes a pair of electric motors, each of said pair of electric motors being drivingly coupled to at least one of said plurality of wheels on one respective side of said main frame by a chain and sprocket transmission.

5. The powered wheelchair of claim 1, further comprising a pair of hand grips coupled to said hand grip support frame in laterally spaced relationship and extending from said hand grip support frame in a substantially vertically downward direction.

6. The powered wheelchair of claim 1, where each of said pair of single axis thumbwheel controls is coupled to said control system to control both speed and rotational direction of a respective one of said pair of electric motors, whereby wheelchair speed is controlled by operating said single axis thumbwheel controls in unison and steering of said wheelchair is effectuated by operating said single axis thumbwheel controls differentially.

7. The powered wheelchair of claim 1, where a first of said pair of single axis thumbwheel controls is coupled to said control system to control speed of said pair of electric motors selectively in either of two opposing rotational directions to propel the powered wheelchair forward or backward, the second of said pair of single axis thumbwheel controls being coupled to said control system to control a turning radius of the powered wheel chair, the control system controlling the speed of the pair of electric motors differentially to thereby affect steering of the wheelchair responsive to displacement of an actuator of said second single axis thumbwheel control.

8. The powered wheelchair of claim 1, where said portable power source includes a pair of batteries interchangeably mounted to said main frame, only one of said pair of batteries being electrically coupled to said control system for powering said control system and said electric drive system through said control system, the other of said pair of batteries serving as a spare to alternately be connected to said control system.

9. The powered wheelchair of claim 1, where said electric drive system includes a pair of electric motors, each of said pair of electric motors being drivingly coupled to a pair of said plurality of wheels on one respective side of said main frame by a chain and sprocket transmission.

10. The powered wheelchair of claim 1, where said plurality of wheels is defined by two pairs of drive wheels rotatably coupled to said main frame, each pair of said two pairs of drive wheels being on a respective one of said opposing sides of said main frame, said electric drive system includes a pair of electric motors, each of said pair of electric motors being drivingly coupled to a respective pair of said two pairs of drive wheels and thereby forming a four wheel drive system.

11. A powered wheelchair for beach terrain, comprising:

a frame assembly including a main frame and a hand grip support frame extending substantially vertically upward from a rear end of said main frame, said hand grip support frame including a horizontal frame member;

an occupant seat assembly mounted to said main frame adjacent a front end thereof;

a plurality of wheels rotatably coupled to said main frame on two opposing sides thereof;

a pair of electric motors mounted to said main frame, each of said pair of electric motors being drivingly coupled to at least one of said plurality of wheels on one respective side of said main frame;

a portable power source mounted to said main frame; and a control system mounted to said main frame and electrically coupled to said portable power source and said pair of electric motors, said control system including a first set of operating controls disposed in proximity to said occupant seat assembly for use by an occupant thereof and a second set of operating controls disposed in proximity to said hand grip support frame for use by an assistant operator, said control system further including a motor drive circuit for each of said pair of electric motors and an emergency stop circuit, said emergency stop circuit is initiated to electrically disconnect said portable power source from said motor drive circuits responsive to detection of either of a manual operation of at least one emergency stop switch or detection of a failure of either of said motor drive circuits, said initiation of said emergency stop circuit activates dynamic braking of said pair of electric motors.

12. The powered wheelchair of claim 11, where said control system further includes a control processor and a switch coupled to said control processor for selectively enabling only one of said first and second sets of operating controls.

13. The powered wheelchair of claim 11, where said emergency stop circuit includes a first emergency stop switch disposed in proximity to said occupant seat assembly for use by the occupant and a second emergency stop switch disposed in proximity to said hand grip support frame for use by an assistant operator, said emergency stop circuit being initiated by operation of either of said first emergency stop switch or said second emergency stop switch.

14. The powered wheelchair of claim 11, further comprising a pair of hand grips coupled to said horizontal frame member in laterally spaced relationship and extending from said horizontal frame member in a substantially vertically downward direction.

15. The powered wheelchair of claim 11, where said second set of operating controls includes a pair of single axis thumbwheel controls respectively positioned adjacent a pair of hand grips to be operable by the assistant operator while the pair of hand grips is being held by the assistant operator.

16. The powered wheelchair of claim 15, where each of said pair of single axis thumbwheel controls is coupled to said control system to control both speed and rotational direction of a respective one of said pair of electric motors, whereby wheelchair speed is controlled by operating said single axis thumbwheel controls in unison and steering of said wheelchair is effectuated by operating said single axis thumbwheel controls differentially.

17. The powered wheelchair of claim 15, where a first of said pair of single axis thumbwheel controls is coupled to said control system to control speed of said pair of electric motors selectively in either of two opposing rotational directions to propel the powered wheelchair forward or backward, the second of said pair of single axis thumbwheel controls being coupled to said control system to control a turning radius of the powered wheel chair, the control system controlling the speed of the pair of electric motors differentially to thereby affect steering of the wheelchair responsive to displacement of an actuator of said second single axis thumbwheel control.

18. The powered wheelchair of claim 11, where said portable power source includes a pair of batteries interchangeably mounted to said main frame, only one of said pair of batteries being electrically coupled to said control system for powering said control system and said electric drive system through said control system, the other of said pair of batteries serving as a spare to alternately be connected to said control system.

19. The powered wheelchair of claim 11, where said pair of electric motors are each drivingly coupled to a pair of said plurality of wheels on one respective side of said main frame by a chain and sprocket transmission.

20. A powered wheelchair for beach terrain, comprising:

a frame assembly including a main frame;

an occupant seat assembly mounted to said main frame adjacent a front end thereof;

two pairs of drive wheels rotatably coupled to said main frame, each pair of said two pairs of drive wheels being disposed on a respective one of two opposing sides of said main frame;

a pair of electric motors mounted to said main frame, each of said pair of electric motors being drivingly coupled to a respective pair of said two pairs of drive wheels and thereby forms a four wheel drive system;

a portable power source mounted to said main frame; and a control system mounted to said main frame and electrically coupled to said portable power source and said pair of electric motors, said control system including a speed and direction control disposed in proximity to said occupant seat assembly for use by an occupant thereof and a motor drive circuit for each of said pair of electric motors said control system further includes a first emergency stop switch disposed in proximity to said occupant seat assembly for use by an occupant thereof, said control system further including an emergency stop circuit, said emergency stop circuit being initiated to electrically disconnect said portable power source from said motor drive circuits responsive to detection of either of a manual operation of said emergency stop switch, a failure of said speed and direction control or detection of a failure of either of said motor drive circuits, said initiation of said emergency stop circuit activates dynamic braking of said pair of electric motors.

21. The powered wheelchair of claim 20, where said portable power source includes a pair of batteries interchangeably mounted to said main frame, only one of said pair of batteries being electrically coupled to said control system for powering said control system and said pair of electric motors through said control system, the other of said pair of batteries serving as a spare to alternately be connected to said control system.

22. The powered wheelchair of claim 20, where said frame assembly further includes a hand grip support frame extending substantially vertically upward from a rear end of said main frame, said hand grip support frame including a horizontal frame member and a pair of hand grips coupled to said horizontal frame member and extending therefrom in a substantially vertically downward direction.

23. The powered wheelchair of claim 22, where said control system further includes a pair of single axis thumbwheel controls respectively positioned adjacent said pair of hand grips to be operable by an assistant operator while holding he pair of hand grips.

24. The powered wheelchair of claim 23, where said control system further includes a control processor and a switch coupled to said control processor for selectively enabling only one of said speed and direction control and said pair of single axis thumbwheel controls.

25. The powered wheelchair of claim 20, where said frame assembly further includes a hand grip support frame extending substantially vertically upward from a rear end of said main frame, said hand grip support frame including a horizontal frame member and a pair of hand grips coupled to said horizontal frame member and extending therefrom in a substantially vertically downward direction, and aid control system further includes a pair of single axis thumbwheel controls respectively positioned adjacent said pair of hand grips to be operable by an assistant operator while holding he pair of hand grips.

26. The powered wheelchair of claim 25, where said control system further includes a second emergency stop switch disposed in proximity to one of said pair of single axis thumbwheel controls, said emergency stop circuit being initiated by operation of either of said first emergency stop switch or said second emergency stop switch.

* * * * *